US010224040B2

(12) United States Patent
Huang et al.

(10) Patent No.: US 10,224,040 B2
(45) Date of Patent: Mar. 5, 2019

(54) PACKET LOSS CONCEALMENT APPARATUS AND METHOD, AND AUDIO PROCESSING SYSTEM

(71) Applicants: Dolby International AB, Amsterdam Zuidoost (NL); Dolby Laboratories Licensing Corporation, San Francisco, CA (US)

(72) Inventors: Shen Huang, Beijing (CN); Xuejing Sun, Beijing (CN); Heiko Purnhagen, Sundyberg (SE)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 253 days.

(21) Appl. No.: 14/899,238

(22) PCT Filed: Jul. 2, 2014

(86) PCT No.: PCT/US2014/045181

§ 371 (c)(1),
(2) Date: Dec. 17, 2015

(87) PCT Pub. No.: WO2015/003027

PCT Pub. Date: Jan. 8, 2015

(65) Prior Publication Data

US 2016/0148618 A1 May 26, 2016

Related U.S. Application Data

(60) Provisional application No. 61/856,160, filed on Jul. 19, 2013.

(30) Foreign Application Priority Data

Jul. 5, 2013 (CN) ..... 2013 1 0282083

(51) Int. Cl.
*G10L 19/005* (2013.01)
*G10L 19/02* (2013.01)
(Continued)

(52) U.S. Cl.
CPC ..... *G10L 19/005* (2013.01); *G10L 19/008* (2013.01); *G10L 19/0212* (2013.01); *G10L 19/167* (2013.01)

(58) Field of Classification Search
None
See application file for complete search history.

(56) References Cited

U.S. PATENT DOCUMENTS 7,552,048 B2 6/2009 Xu
7,693,721 B2 4/2010 Baumgarte
(Continued)

FOREIGN PATENT DOCUMENTS

CN 101401151 4/2009
CN 102436819 5/2012
(Continued)

OTHER PUBLICATIONS

Karadimou, K. et al "Packets Loss Concealment for Multichannel Audio Using the Multiband Source/Filter Model", IEEE Fortieth Asilomar Conference on Signals, Systems and Computers, Oct. 29, 2006-Nov. 1, 2006, pp. 1105-1109.
(Continued)

*Primary Examiner* — Paul Huber

(57) ABSTRACT

The present application relates to packet loss concealment apparatus and method, and audio processing system. According to an embodiment, the packet loss concealment apparatus is provided for concealing packet losses in a stream of audio packets, each audio packet comprising at least one audio frame in transmission format comprising at least one monaural component and at least one spatial
(Continued)

component. The packet loss concealment apparatus may comprises a first concealment unit for creating the at least one monaural component for a lost frame in a lost packet and a second concealment unit for creating the at least one spatial component for the lost frame. According to the embodiment, spatial artifacts such as incorrect angle and diffuseness may be avoided as far as possible in PLC for multi-channel spatial or sound field encoded audio signals.

20 Claims, 16 Drawing Sheets

(51) Int. Cl.
*G10L 19/008* (2013.01)
*G10L 19/16* (2013.01)

(56) References Cited

U.S. PATENT DOCUMENTS

| | | | |
|---|---|---|---|
| 7,835,916 | B2 | 11/2010 | Bruhn |
| 8,112,286 | B2 | 2/2012 | Goto |
| 8,260,608 | B2 | 9/2012 | Opitz |
| 8,355,911 | B2 | 1/2013 | Zhan |
| 8,359,196 | B2 | 1/2013 | Yoshida |
| 2004/0039464 | A1 | 2/2004 | Virolainen |
| 2005/0141721 | A1 | 6/2005 | Aarts |
| 2005/0182996 | A1 | 8/2005 | Bruhn |
| 2008/0033583 | A1 | 2/2008 | Zopf |
| 2008/0175394 | A1 | 7/2008 | Goodwin |
| 2009/0083045 | A1 | 3/2009 | Briand |
| 2010/0280822 | A1* | 11/2010 | Yoshida ..... G10L 19/005 704/201 |
| 2011/0129092 | A1 | 6/2011 | Virette |
| 2011/0208517 | A1 | 8/2011 | Zopf |
| 2012/0065984 | A1 | 3/2012 | Yamanashi |
| 2012/0265523 | A1 | 10/2012 | Greer |
| 2012/0278089 | A1 | 11/2012 | Oh |
| 2013/0044224 | A1 | 2/2013 | Liao |
| 2015/0255079 | A1 | 9/2015 | Huang |

FOREIGN PATENT DOCUMENTS

| | | |
|---|---|---|
| JP | 2004-120619 | 4/2004 |
| JP | 2010-102042 | 5/2010 |
| WO | 2012/025431 | 3/2012 |
| WO | 2012/167479 | 12/2012 |
| WO | 2015/000819 | 1/2015 |

OTHER PUBLICATIONS

Zheng, X. et al "Packet Loss Protection for Interactive Audio Object Rendering: A Multiple Description Approach" IEEE Fourth International Workshop on Quality of Multimedia Experience, Jul. 5-7, 2012, pp. 68-73.

G 722: "ITU-T G.722 7 kHz Audio Coding within 64 kbit/s" ITU-T Recommendation, Sep. 16, 2012, pp. 1-262.

ETSI: "ETSI TS 102 563 V1.2.1. Digital Audio Broadcasting (DAB): Transport of Advanced Audio Coding (AAC)" May 31, 2005, pp. 1-27.

* cited by examiner

PACKET LOSS CONCEALMENT APPARATUS AND METHOD, AND AUDIO PROCESSING SYSTEM

CROSS-REFERENCE TO RELATED APPLICATIONS

This application claims priority from Chinese Priority Patent Application No. 201310282083.3 filed 5 Jul. 2013 and U.S. Provisional Patent Application Nos. 61/856,160 filed 19 Jul. 2013, each of which is hereby incorporated by reference in its entirety.

TECHNICAL FIELD

The present application relates generally to audio signal processing. Embodiments of the present application relate to the concealment of artifacts that result from loss of spatial audio packets during audio transmission over a packet-switched network. More specifically, embodiments of the present application relate to packet loss concealment apparatus, packet loss concealment methods, and an audio processing system comprising the packet loss concealment apparatus.

BACKGROUND

Voice communication may be subject to different quality problems. For example, if the voice communication is conducted on a packet-switch network, due to delay jitters occurring in the network or due to bad channel conditions, such as fading or WIFI interference, some packets may be lost. Lost packets result in clicks or pops or other artifacts that greatly degrade the perceived speech quality at the receiver side. To combat the adverse impact of packet loss, packet loss concealment (PLC) algorithms, also known as frame erasure concealment algorithms, have been proposed. Such algorithms normally operate at the receiver side by generating a synthetic audio signal to cover missing data (erasures) in a received bit stream. These algorithms are proposed mainly for mono signals either in time or in frequency domain. Based on whether the concealment occurs before or after the decoding, the mono channel PLC can be classified into coded, decoded, or hybrid domain methods. Applying a mono channel PLC to a multi-channel signal directly may lead to undesirable artifacts. For example, a decoded domain PLC may be performed separately for each channel after each channel is decoded. One disadvantage of such an approach is that spatially distorted artifact as well as unstable signal levels can be observed due to the lack of consideration of correlations across channels. Spatial artifacts such as incorrect angle and diffuseness can degrade the perceptual quality of spatial audio significantly. Therefore, there is a need for a PLC algorithm for multi-channel spatial or sound field encoded audio signals.

SUMMARY

According to an embodiment of the application, a packet loss concealment apparatus is provided for concealing packet losses in a stream of audio packets, each audio packet comprising at least one audio frame in transmission format comprising at least one monaural component and at least one spatial component. The packet loss concealment apparatus includes a first concealment unit for creating the at least one monaural component for a lost frame in a lost packet and a second concealment unit for creating the at least one spatial component for the lost frame.

The packet loss concealment apparatus above may be applied in either intermediate apparatus such as a server, e.g., an audio conference mixing server, or communication terminal used by an end user.

The present application also provides an audio processing system that includes the server comprising the packet loss concealment apparatus described above and/or and the communication terminal comprising the packet loss concealment apparatus as described above.

Another embodiment of the present application provides a packet loss concealment method for concealing packet losses in a stream of audio packets, each audio packet comprising at least one audio frame in transmission format comprising at least one monaural component and at least one spatial component. The packet loss concealment method includes creating the at least one monaural component for a lost frame in a lost packet; and/or creating the at least one spatial component for the lost frame.

The present application also provides a computer-readable medium having computer program instructions recorded thereon, when being executed by a processor, the instructions enabling the processor to execute a packet loss concealment method as described above.

BRIEF DESCRIPTION OF DRAWINGS

The present application is illustrated by way of example, and not by way of limitation, in the figures of the accompanying drawings and in which like reference numerals refer to similar elements and in which.

DETAILED DESCRIPTION

Figure 1:
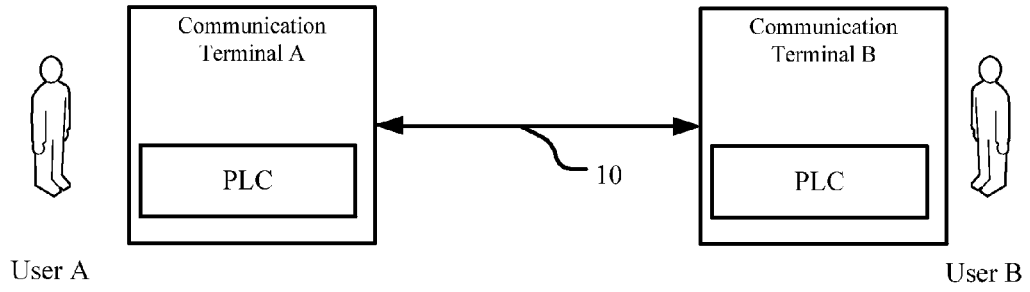
FIG. 1 is a diagram schematically illustrating an exemplary voice communication system where embodiments of the application can be applied.

The embodiments of the present application are described below by referring to the drawings. It is to be noted that, for the purpose of clarity, representations and descriptions about those components and processes known by those skilled in the art but not necessary to understand the present application are omitted in the drawings and the description.

As will be appreciated by one skilled in the art, aspects of the present application may be embodied as a system, a device (e.g., a cellular telephone, a portable media player, a personal computer, a server, a television set-top box, or a digital video recorder, or any other media player), a method or a computer program product. Accordingly, aspects of the present application may take the form of an hardware embodiment, an software embodiment (including firmware, resident software, microcodes, etc.) or an embodiment combining both software and hardware aspects that may all generally be referred to herein as a "circuit," "module" or "system." Furthermore, aspects of the present application may take the form of a computer program product embodied in one or more computer readable mediums having computer readable program code embodied thereon.

Any combination of one or more computer readable mediums may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic or optical signal, or any suitable combination thereof.

A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wired line, optical fiber cable, RF, etc., or any suitable combination of the foregoing.

Computer program code for carrying out operations for aspects of the present application may be written in any combination of one or more programming languages, including an object oriented programming language such as Java, Smalltalk, C++ or the like and conventional procedural programming languages, such as the "C" programming language or similar programming languages. The program code may execute entirely on the user's computer as a stand-alone software package, or partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present application are described below with reference to flowchart illustrations and/or block diagrams of methods, apparatus (systems) and computer program products according to embodiments of the application. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Overall Solutions

FIG. 1 is a diagram schematically illustrating an example voice communication system where embodiments of the application can be applied.

As illustrated in FIG. 1, user A operates a communication terminal A, and user B operates a communication terminal B. In a voice communication session, user A and user B talk to each other through their communication terminals A and B. The communication terminals A and B are coupled through a data link 10. The data link 10 may be implemented as a point-to-point connection or a communication network. At either side of user A and user B, packet loss detection (not shown) is performed on audio packets transmitted from the other side. If a packet loss is detected, then packet loss concealment (PLC) may be performed to conceal the packet loss so that the reproduced audio signal sounds more complete and with fewer artifacts caused by the packet loss.

Figure 2:
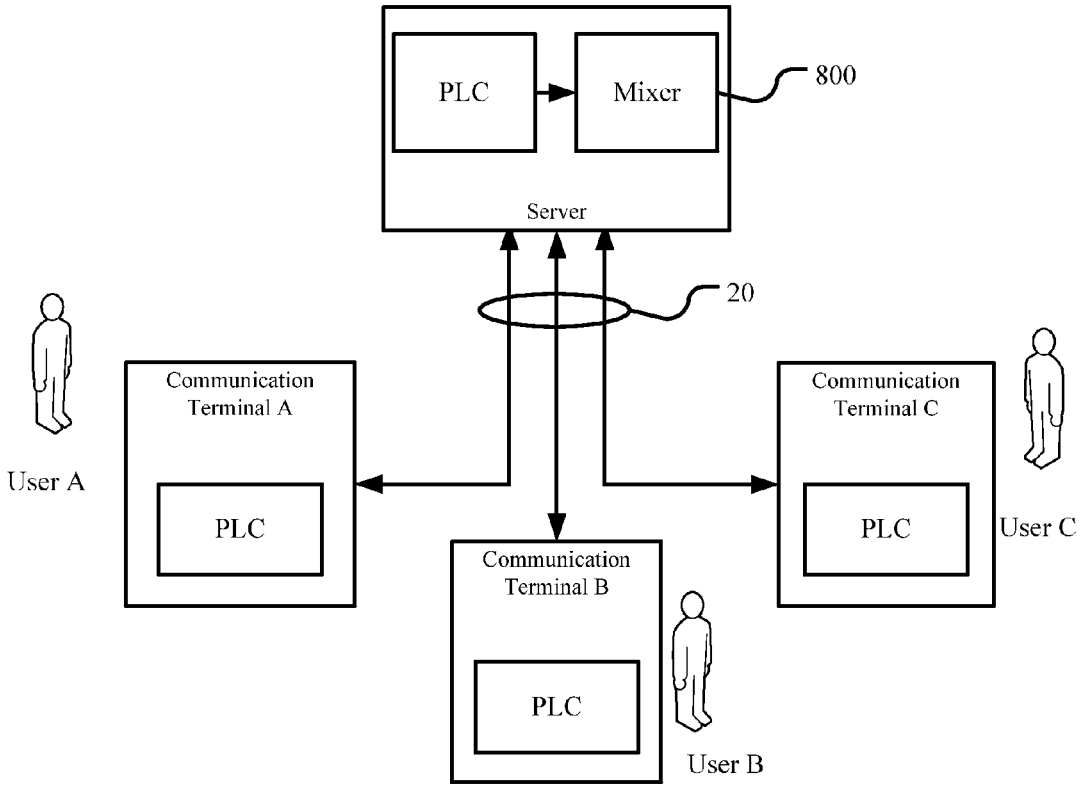
FIG. 2 is a diagram schematically illustrating another exemplary voice communication system where embodiments of the application can be applied.

FIG. 2 is a diagram schematically illustrating another example voice communication system where embodiments of the application can be applied. In this example, a voice conference may be conducted among users.

As illustrated in FIG. 2, user A operates a communication terminal A, user B operates a communication terminal B, and user C operates a communication terminal C. In a voice conference session, user A, user B and user C talk to each other through their communication terminals A, B and C. The communication terminals illustrated in FIG. 2 have the same function as those illustrated in FIG. 1. However, the communication terminals A, B, and C are coupled to a server through a common data link 20 or separate data links 20. The data link 20 may be implemented as a point-to-point connection or a communication network. At either side of user A, user B, and user C, packet loss detection (not shown) is performed on audio packets transmitted from the other one or two sides. If a packet loss is detected, then packet loss concealment (PLC) may be performed to conceal the packet loss so that the reproduced audio signal sounds more complete and with fewer artifacts caused by the packet loss.

Packet loss may occur anywhere on the path from an originating communication terminal to the server and then to a destination communication terminal. Therefore, alternatively or additionally, packet loss detection (not shown) and PLC may also be performed in the server. For performing packet loss detection and PLC in the server, the packets received by the server may be de-packetized (not shown). Then, after PLC, packet-loss concealed audio signal may be again packetized (not shown) so as to be transmitted to the destination communication terminal. If there are two users talking at the same time (and this could be determined with Voice Activity Detection (VAD) techniques), before transmitting the speech signals of the two users to the destination communication terminal, mixing operation needs be done in a mixer 800 to mix the two streams of speech signals into one. This may be done after the PLC but before the packetizing operation.

Although three communication terminals are illustrated in FIG. 1B, there can reasonably be more communication terminals coupled in the system.

The present application tries to solve the packet loss problem of sound field signals by applying different concealment methods to mono and spatial components respectively which are obtained through appropriate transform techniques applied to the sound field signals. Specifically, the present application relates to constructing artificial signals in spatial audio transmission when packet loss happens.

Figure 3:
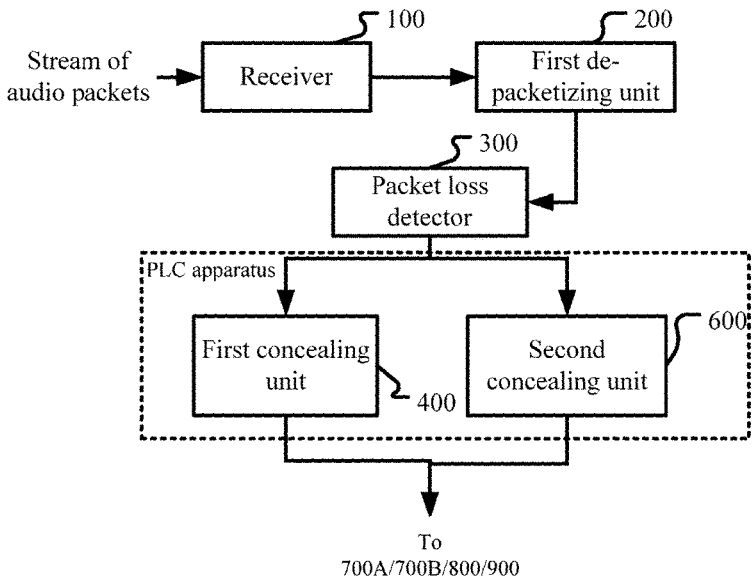
FIG. 3 is a diagram illustrating a packet loss concealment apparatus according to an embodiment of the application.

As shown in FIG. 3, in one embodiment, a packet loss concealment (PLC) apparatus is provided for concealing packet losses in a stream of audio packets, each audio packet comprising at least one audio frame in transmission format comprising at least one monaural component and at least one spatial component. The PLC apparatus may include a first concealment unit 400 for creating the at least one monaural component for a lost frame in a lost packet; and a second concealment unit 600 for creating the at least one spatial component for the lost frame. The created at least one monaural component and the created at least one spatial component constitute a created frame for substituting the lost frame.

As known in the art, to cater transmission, audio stream has been transformed and stored in frame structure, which may be called "transmission format", and has been packetized into audio packets in the originating communication terminal, and then received by the receiver 100 in a server or in a destination communication terminal. For performing PLC, a first de-packetizing unit 200 may be provided for de-packetizing each audio packet into the at least one frame comprising the at least one monaural component and the at least one spatial component, and a packet loss detector 300 may be provided for detecting packet losses in the stream. The packet loss detector 300 may or may not be regarded as a part of the PLC apparatus. For the originating communication terminal, any technique can be adopted to transform the audio stream into any suitable transmission format.

One example of the transmission format may be obtained with adaptive transform such as adaptive orthogonal transform, which can result in a plurality of monaural components and spatial components. For example, the audio frames may be parametric eigen signal encoded based on parametric eigen decomposition, the at least one monaural component may comprise at least one eigen channel component (such as at least primary eigen channel component), and the at least one spatial component comprises at least one spatial parameter. Again for example, the audio frames may be decomposed by principle component analysis (PCA) and the at least one monaural component may comprise at least one principle component based signal, and the at least one spatial component comprises at least one spatial parameter.

Accordingly, in the originating communication terminal a transformer for transforming the input audio signal into the parametric eigen signal may be comprised. Depending on the format of the input audio signal, which may be called "input format", the transformer may be realized with different techniques.

For example, the input audio signal may be ambisonic B-format signal and the corresponding transformer may conduct adaptive transform, such as KLT (Karhunen-Loeve Transform) on the B-format signal to obtain the parametric eigen signal comprised of eigen channel components (which may also be called as rotated audio signals) and spatial parameters. Typically, LRS (Left, Right and Surround) signals or other artificially up-mixed signals can be converted to first order ambisonic format (B-format), that is, WXY sound-field signals (which may also be WXYZ sound-filed signals, but in voice communication with LRS capture, only horizontal WXY is considered), and the adaptive transform can jointly encode all 3 channels W, X and Y of the sound-field signals into a new set of eigen channel components (rotated audio signals) Em(m=1, 2, 3) (that is E1, E2, E3, the number m may be more or less) in a decreasing order of informational importance. The transform, typically through a 3×3 transform matrix (such as a covariance matrix) if the number of eigen signals is 3, can be described by a set of 3 spatial side parameters (d, $\varphi$ and $\theta$) that are sent as side-information, such that a decoder can apply inverse transform to reconstruct the original sound-field signals. Notice that if a packet loss occurs in transmission, neither the eigen channel components (rotated audio signals) nor the spatial side parameters could be obtained by the decoder.

Alternatively, the LRS signal may be directly transformed into parametric eigen signals.

The aforementioned coding structure may be called adaptive transform coding. Although, as mentioned, the coding may be performed with any adaptive transforms including KLT, or any other schema including direct transform from LRS signals to parametric eigen signals, the present application provides an example of specific algorithm to transform input audio signals into parametric eigen signals. For details, please see the part "Forward and Inverse Adaptive Transform of Audio Signal" in this application.

In the adaptive transform coding discussed above, if bandwidth is abundant, all of E1, E2 and E3 will be coded in the frames and then packetized in the packet stream, which is referred to as discrete coding. Otherwise, if bandwidth is limited, an alternative approach may be considered, whereas E1 is a perceptually meaningful/optimized mono-representation of the original sound-field, and E2, E3 can be reconstructed via calculation of pseudo de-correlated signals. In practical embodiments, weighted combination of E1 and de-correlated version of E1 is preferable, where the de-correlated version may be simply a delayed copy of E1, and the weighting factors may be computed based on the proportion of band energy of E1 vs. E2, and E1 vs. E3. This approach may be called predictive coding. For details, please see the part "Forward and Inverse Adaptive Transform of Audio Signal" in this application.

Then, in the input audio stream, each frame comprises a set of frequency domain coefficients (for E1, E2 and E3), of the monaural component, and quantized side parameters, which may be called spatial components or spatial parameters. Side parameters may also include predictive parameters if predictive coding is applied. When a packet loss happens, in discrete coding, both Em (m=1, 2, 3) and spatial parameters are lost in the transmission process; whereas in predictive coding, a lost packet leads to the loss of predictive parameters, spatial parameters and E1.

The operation of the first de-packetizing unit 200 is an inverse operation of the packetizing unit in the originating communication terminal, and its detailed description is omitted here.

In packet loss detector 300, any existing techniques may be adopted to detect packet loss. A common approach is to detect the sequence numbers of packets/frames de-packetized by the de-packetizing unit 200 from received packets, the discontinuity of the sequential numbers indicates loss of packets/frames of the missed sequential numbers.

Sequence number is normally a mandatory field in a VoIP packet format, such as the Real-time Transport Protocol (RTP) format. Note that presently a packet generally comprises one frame (generally 20 ms), but it is also possible that a packet comprises more than one frame, or one frame may span several packets. If a packet is lost, then all the frames in the packet are lost. If a frame is lost, it must be the result of one or more lost packets, and the packet loss concealment is generally implemented on frame-basis, that is, the PLC is for restoring lost frame(s) due to lost packet. Therefore, in the context of the present application, a packet loss is generally equivalent to a frame loss and the solutions are generally described with respect to frames, unless otherwise the packets must be mentioned, for example for emphasizing the number of lost frames in a lost packet. And in the claims, the wording "each audio packet comprising at least one audio frame" shall be construed as covering the situation where one frame spans more than one packet, and correspondingly the wording "a lost frame in a lost packet" shall be construed as covering an "at least partially lost frame spanning more than one packet" due to at least one lost packet.

In the present application, it is proposed to implement independent packet loss concealment operations on monaural components and on spatial components, and thus the first concealment unit 400 and the second concealment unit 600 are respectively provided. For the first concealment unit 400, it may be configured to create the at least one monaural component for the lost frame by replicating the corresponding monaural component in an adjacent frame.

In the context of the present application, "adjacent frame" means a frame before or after the present frame (maybe a lost frame), either immediately or with other interposed frame(s). That is, for restoring a lost frame, either a future frame or a history frame may be used, and we generally may use the immediately adjacent future or history frame. An immediately adjacent history frame may be called "the last frame". In a variant, when replicating the corresponding monaural component, an attenuation factor may be used.

When there are at least two successive frames that have been lost, then the first concealment unit 400 may be configured to replicate the history frame(s) or the future frame(s) respectively for earlier or later lost frames among the at least two successive frames. That is, the first concealment unit may create the at least one monaural component for at least one earlier lost frame by replicating the corresponding monaural component in an adjacent history frame, with or without an attenuation factor, and create the at least one monaural component for at least one later lost frame by replicating the corresponding monaural component in an adjacent future frame, with or without an attenuation factor.

For the second concealment unit 600, it may be configured to create the at least one spatial component for the lost frame by smoothing the values of the at least one spatial component of adjacent frame(s), or by replicating the corresponding spatial component in the last frame. As a variant, the first concealment unit 400 and the second concealment unit may adopt different concealment methods.

In some scenarios where delay may be allowed or tolerated, future frames may also be used to contribute to the determination of the spatial component of the lost frame. For example, an interpolation algorithm may be used. That is, the second concealment unit 600 may be configured to create the at least one spatial component for the lost frame through the interpolation algorithm based on the values of the corresponding spatial component in at least one adjacent history frame and at least one adjacent future frame.

When at least two packets or at least two frames are lost, the spatial components of all the lost frames may be determined based on the interpolation algorithm.

Figure 4:
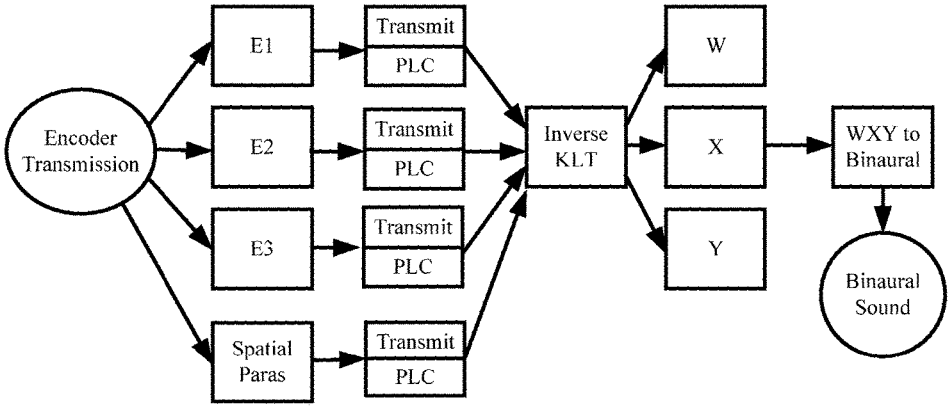
FIG. 4 is a diagram illustrating a specific example of the packet loss concealment apparatus in FIG. 3.

As mentioned before, there are various possible input formats and transmission formats. FIG. 4 shows an example of using parametric eigen signals as the transmission format. As shown in FIG. 4, the audio signal is encoded and transmitted as parametric eigen signals, including eigen channel components as the monaural components and spatial parameters as the spatial components (for details on the encoding side, please refer to the part "Forward and Inverse Adaptive Transform of Audio Signal). Specifically in the example, there are three eigen channel components Em (m=1, 2, 3) and corresponding spatial parameters, such as diffuseness d (directivity of E1), azimuth angle $\varphi$ (horizontal direction of E1), and $\theta$ (rotation of E2, E3 around E1 in 3-D space). For normally transmitted packets, both the eigen channel components and the spatial parameters are normally transmitted (within packets); while for a lost packet/frame, both the eigen channel components and the spatial parameters are lost, and PLC will be conducted for creating new eigen channel components and spatial parameters to replace those of the lost packet/frame. If in destination communication terminals, the normally transmitted or created eigen channel components and spatial parameters may be directly reproduced (e.g. as a binaural sound) or transformed first into proper intermediate output format, which may be subject to further transformation or directly reproduced. Similar to the input format, the intermediate output format may be any feasible format, such as ambisonic B-format (WXY or WXYZ sound-field signal), LRS or other format. The audio signal in the intermediate output format may be directly reproduced, or may be subject to further transformation to be adapted to the reproducing device. For example, the parametric eigen signal may be transformed into a WXY sound-field signal through inverse adaptive transform, such as inverse KLT (see the part "Forward and Inverse Adaptive Transform of Audio Signal" in this application), and then further transformed into binaural sound signals if binaural playback is required. Correspondingly, the packet loss concealment apparatus of the present application may comprise a second inverse transformer to perform an inverse adaptive transform on the audio packet (subject to possible PLC) to obtain an inverse transformed sound field signal.

In FIG. 4, the first concealment unit 400 (FIG. 3) may use conventional mono PLC, such as replication with or without attenuation factor as mentioned before and shown below:

$$\widehat{Em}(p,k)=g*Em(p-1,k),\ m\in\{2,3\},\ k\in[1,K] \tag{1}$$

where the $p^{th}$ frame has been lost, loss of $\widehat{Em}(p,k)$ is concealed via replicating the last that is the $(p-1)^{th}$ frame Em(p−1,k) with an attenuation factor g. m is the eigen channel number, k is the frequency bin number and K is the number of coefficients assuming that for the frames Modified discrete cosine transform (MDCT) coding is adopted (but the present application is not limited thereto and other coding schema may be adopted). The value range of g may be (0.5,1], and when g=1, it is equivalent to simple replication without attenuation factor.

In a variation, if there are multiple successive lost frames, they can be restored by replicating adjacent history and future frames. Assuming the first lost frame is frame p and the last lost frame is frame q, then for the first half of the lost frames, $$\widehat{Em}(p+a,k)=g^{a+1}*Em(p-1,k),\ m\in\{2,3\},\ k\in[1,K] \tag{1'}$$

Where a=0, 1, . . . A−1, A is the number of the first half of the lost frames. And for the second half of the lost frames:

$$\widehat{Em}(q-b,k)=g^{b+1}*Em(q+1,k),\ m\in\{2,3\},\ k\in[1,K] \tag{1''}$$

Where b=0, 1, . . . B−1, B is the number of the second half of the lost frames. A may be the same or different from B. In the above two formulae, the attenuation factor g adopts the same value for all the lost frames, but it may also adopt different values for different lost frames.

Apart from channel concealment, spatial concealment is also important. In the example shown in FIG. 4, spatial parameters may be composed of d, φ, and θ. Stability of spatial parameters is critical in maintaining perceptual continuity. So the second concealment unit 600 (FIG. 3) may be configured to smoothing the spatial parameters directly. The smoothing may be implemented with any smoothing approaches, such as by calculating a history average:

$$\hat{d}_p=\alpha\hat{d}_{p-1}+(1-\alpha)d_p,\ \hat{\varphi}_p=\alpha\hat{\varphi}_{p-1}+(1-\alpha)\varphi_p,\ \hat{\varphi}_p=\alpha\hat{\theta}_{p-1}+(1-\alpha)\theta_p; \tag{2}$$

Where $\hat{d}_p$ is the restored (smoothed) value of the spatial parameter d of the present $p^{th}$ frame, $d_p$ is the value of the spatial parameter d of the present frame. $\hat{d}_{p-1}$ is the restored (smoothed) value of the spatial parameter d of the last $((p-1)^{th})$ frame. For a lost frame, $d_p=0$, and $\hat{d}_p$ may be used as the corresponding spatial parameter value of the restored frame. α is a weighting factor has a range of (0.8,1], or adaptively produced based on other physical property like diffuseness of frame p. For φ or θ the situation is similar.

Other examples of smoothing operation may include calculating a moving average by using a moving window, which may cover history frames only or cover both history frames and future frames. In other words, the values of the spatial parameters may be obtained through an interpolation algorithm based on adjacent frames. In such a situation, multiple adjacent lost frames may be restored at the same time with the same interpolation operation:

In some scenarios where the stability of the spatial parameters are relatively high, e.g. $d_p$ of the current frame p has been detected with a large value, simple replication of spatial parameters may be also an efficient, yet effective approach in the context of PLC:

$$\hat{d}_p=d_{p-1},\ \hat{\varphi}_p=\varphi_{p-1},\ \hat{\theta}_p=\theta_{p-1}; \tag{3}$$

where $\hat{d}_p$ is the restored value of the spatial parameter d of the lost $p^{th}$ frame, $d_{p-1}$ is the value of the spatial parameter d of the last $(p-1)^{th}$ frame. For φ or θ the situation is similar.

Decomposing the multi-channel signal into mono and spatial components offers additional flexibilities in transmission which can further improve resilience to packet losses. In one embodiment, the spatial parameters, which normally consume less bandwidth compared to the monaural signal components, can be sent as redundant data. For example, the spatial parameters of packet p may be piggybacked to packet p−1 or p+1 such that when packet p is lost, its spatial parameters can be extracted from adjacent packets. In yet another embodiment, the spatial parameters are not sent as redundant data and simply sent in a packet different from the monaural signal component. For example, the spatial parameters of the $p^{th}$ packet are transmitted by the $(p-1)^{th}$ packet. In doing so, if packet p is lost, its spatial parameters can be recovered from packet p−1 if it's not lost. The drawback is the spatial parameters of packet p+1 is also lost.

In the embodiments and examples described above, since the eigen channel components do not contain any spatial information, the risk of spatial distortion caused by inappropriate concealment will be diminished.

PLC for Monaural Component

In FIG. 4, what is illustrated is an example of coded domain PLC in discretely coded bit-stream, where all eigen channel components E1, E2 and E3 and all spatial parameters namely d, φ, and θ need be transmitted and, if necessary, restored for PLC.

Figure 6:
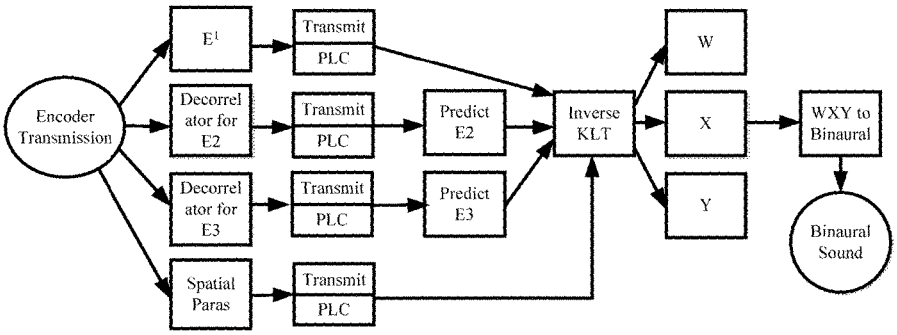
FIG. 6 is a diagram illustrating a specific example of the variation of the packet loss concealment apparatus in FIG. 5.

Discrete coded domain concealment is considered only if there are enough bandwidths for coding E1, E2 and E3. Otherwise, the frames may be encoded by predictive coding schema. In predictive coding, only one eigen channel component, that is the primary eigen channel E1 is really transmitted. On the decoding side, the other eigen channel components such as E2 and E3 will be predicted using predictive parameters, such as a2, b2 for E2 and a3 and b3 for E3 (for details of predictive coding, please refer to the part "Forward and Inverse Adaptive Transform of Audio Signal" in this document). As is shown in FIG. 6, in this scenario, different types of decorrelators for E2 and for E3 are provided (transmitted or restored for PLC). Therefore, as long as E1 is successfully transmitted or restored (with PLC), the other two channels E2 and E3 can be directly predicted/constructed via decorrelator combination. This process of predictive PLC can save nearly two thirds of the computational load, with only an additional prediction parameter calculation. In addition, since it is not necessary to transmit E2 and E3, bit rate efficiency would be improved. The other parts in FIG. 6 are similar to those in FIG. 4.

Figure 5:
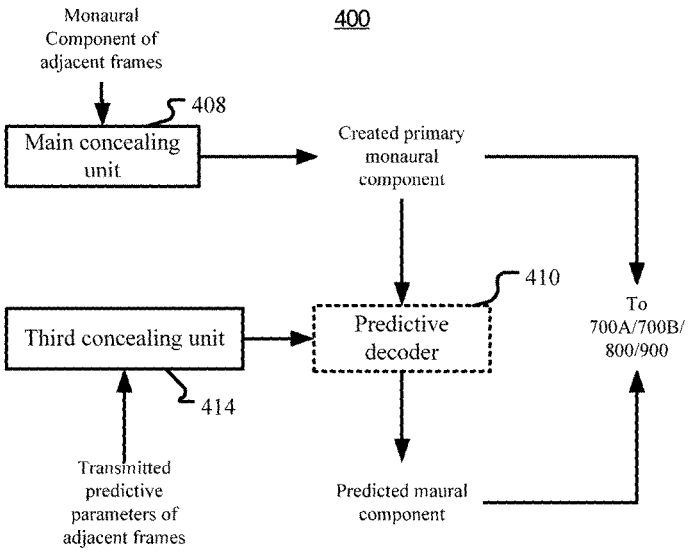
FIG. 5 is a diagram illustrating the first concealment unit 400 in FIG. 3 according to a variation of the embodiment in FIG. 3.

Therefore, in a variant of the embodiment of the packet loss concealment apparatus characterized in the first concealment unit 400 as shown in FIG. 5, when each audio frame further comprises at least one predictive parameter to be used to predict, based on the at least one monaural component in the frame, at least one other monaural component for the frame, the first concealment unit 400 may comprise two sub-concealment units for conducting PLC respectively for the monaural component and the predictive parameter, that is, a main concealment unit 408 for creating the at least one monaural component for the lost frame, and a third concealment unit 414 for creating the at least one predictive parameter for the lost frame.

The main concealment unit 408 may work in the same way as the first concealment unit 400 as discussed hereinbefore. In other words, the main concealment unit 408 may be regarded as the core part of the first concealment unit 400 for creating any monaural component for a lost frame and here it is configured to only create the primary monaural component.

The third concealment unit 414 may work in a way similar to the first concealment unit 400 or the second concealment unit 600. That is, the third concealment unit is configured to create the at least one predictive parameter for the lost frame by replicating the corresponding predictive parameter in the last frame, with or without an attenuation factor, or smoothing the values of corresponding predictive parameter of adjacent frame(s). Assuming frames i+1, i+2, . . . , j−1 have been lost, we can smooth the missing predictive parameters in frame k by this way:

$$a_k=[(j-k)a_i+(k-i)a_j]/(j-i);$$

$$b_k=[(j-k)b_i+(k-i)b_j]/(j-i); \quad (4)$$

Where a and b are predictive parameters.

If in a server and if there is only one audio stream, then mixing operation is unnecessary, and thus predictive decoding is not necessarily to be performed in the server, then the created monaural component and the created predictive parameters may be directly packetized and forwarded to destination communication terminals, where predictive decoding will be performed after de-packetizing but before, for example, inverse KLT in FIG. 6.

If in a destination communication terminal, or mixing operation for multiple audio streams is necessary in a server, then a predictive decoder 410 (FIG. 5) may predict the other monaural components based on the monaural component(s) created by the main concealment unit 408 and the predictive parameters created by the third concealment unit 414. In fact, the predictive decoder 410 may also work on normally transmitted monaural component(s) and predictive parameter(s) for normally transmitted (not lost) frames.

Generally, the predictive decoder 410 may predict, using the predictive parameters another monaural component based on the primary monaural component in the same frame and its decorrelated version. Specifically for a lost frame, the predictive decoder may predict the at least one other monaural component for the lost frame based on the created one monaural component and its decorrelated version using the created at least one predictive parameter. The operation may be expressed s:

$$\widehat{Em}(p,k)=\widehat{am}(p,k)*\widehat{E1}(p,k)+\widehat{bm}(p,k)*dm(\widehat{E1}(p,k)) \quad (5)$$

where $\widehat{Em}$ (p,k) is a predicted monaural component for a lost frame that is the $p^{th}$ frame, k is the frequency bin number, and m may be 2 or 3 assuming there are 3 eigen channel components but the present application is not limited thereto. $\widehat{E1}$ (p,k) is the primary monaural component created by the main concealment unit 408. dm($\widehat{E1}$ (p,k)) is the decorrelated version of $\widehat{E1}$ p,k), and may be different for different m. $\widehat{am}$ (p,k) and $\widehat{bm}$ (p,k) are predictive parameters for corresponding monaural components. Note that formula (5) corresponds to formulae (17) and (18) respectively when m=2 and m=3, but formulae (17), (18) are on the encoder side and formula (5) is on the decoder side, so the symbol ^ is used in formula (5).

Here, if no attenuation factor is used in creating the predictive parameters, it may be used in the formula (5), especially for the decorrelated version of $\widehat{E1}$ (p,k), and especially when the restored primary monaural component has been attached an attenuation factor.

The decorrelated version of $\widehat{E1}$ (p,k) may be calculated in various ways in the art. One way is to take the monaural component in a history frame corresponding to the created one monaural component for the lost frame as the decorrelated version of the created one monaural component, no matter whether the monaural component in the history frame is normally transmitted or is created by the main concealment unit 408. That is:

$$\widehat{Em}(p,k)=\widehat{am}(p,k)*\widehat{E1}(p,k)+\widehat{bm}(p,k)*\widehat{E1}(p-m+1,k) \quad (5')$$

Or:

$$\widehat{Em}(p,k)=\widehat{am}(p,k)*\widehat{E1}(p,k)+\widehat{bm}(p,k)*E1(p-m+1,k) \quad (5'')$$

where E1(p−m+1,k) is the normally transmitted primary monaural component in a history frame, that is the $(p-m+1)^{th}$ frame. While $\widehat{E1}$ (p−m+1,k) is a restored (created) monaural component for the history frame. Note that here we use a history frame determined based on the sequential number of the monaural component, meaning that for a less important monaural component such as eigen channel component (eigen channel components are sequenced based on their importance), an earlier frame will be used. But the present application is not limited thereto.

Note that the operation of the predictive decoder 410 is an inverse process of the predictive coding of E2 and E3. For more details about the operation of the predictive decoder 410, please see the part "Forward and Inverse Adaptive Transform of Audio Signal" of this application, but the present application is not limited thereto.

As mentioned before in formula (1), for a lost frame, the primary monaural component may be created by simply replicating the primary monaural component in the last frame, that is:

$$\widehat{E1}(p,k)=g*\widehat{E1}(p-1,k) \quad (1')$$

Note formula (1') is the formula (1) when m=1 and assuming the primary monaural component for the last frame is also created rather than normally transmitted, for purpose of simplification of the following discussion.

The solution combining formula (1') and formula (5') can work to some extent but have some disadvantages. From formula (1') and formula (5') we can derive:

$$\widehat{Em}(p,k)=\widehat{am}(p,k)*\widehat{E1}(p,k)+\widehat{bm}(p,k)*\widehat{E1}(p-m+1,k))= \quad (6)$$
$$g*\widehat{a2}(p,k)*\widehat{E1}(p,k)+\widehat{b2}(p,k)*\widehat{E1}(p,k),$$
$$\text{when } m=2=\widehat{E1}(p,k)*(g*\widehat{a2}(p,k)+\widehat{b2}(p,k))$$

and $$\widehat{Em}(p,k)=\widehat{am}(p,k)*\widehat{E1}(p,k)+\widehat{bm}(p,k)*\widehat{E1}(p-m+1,k))= \quad (6')$$
$$g*\widehat{a3}(p,k)*\widehat{E1}(p,k)+\widehat{b3}(p,k)*\widehat{E1}(p-2,k),$$
$$\text{when } m=3=g^2*\widehat{a3}(p,k)*\widehat{E1}(p-2,k)+\widehat{b3}(p,k)*\widehat{E1}(p-2,k)=$$
$$\widehat{E1}(p-2,k)*(g^2*\widehat{a3}(p,k)+\widehat{b3}(p,k))$$

That is, $$\widehat{Em}(p,k)=\widehat{E1}(p-m+1,k)*(g^{m-1}*\widehat{am}(p,k)+\widehat{bm}(p,k)) \quad (7)$$

Based on the above formula, we have:

$$\text{Corref}(\widehat{Em}(p),\widehat{E1}(p))=\text{Corref}(\widehat{Em}(p-m+1),\widehat{E1}(p))=1.00 \quad (8)$$

Where the function Corref( ) indicates calculation of correlation, and in formula (8) the frequency bin number k has been omitted.

As the formula (7) shows, $\widehat{Em}$ (p) is linearly weighted by $\widehat{E1}$ (p), which means instead of de-correlation, the calculated E2 and E3 are totally correlated with E1. In order to avoid this re-correlation, we should avoid repetition or replication. For this purpose in this application, a time domain PLC is provided, as shown in the embodiment of FIG. 7 and the example shown in FIG. 8.

Figure 7:
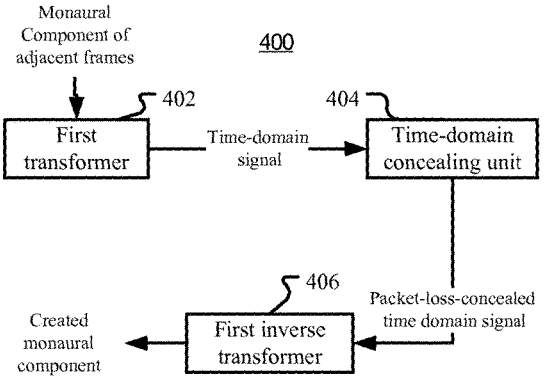
FIG. 7 is a diagram illustrating the first concealment unit 400 in FIG. 3 according to another variation of the embodiment in FIG. 3.

As shown in FIG. 7, the first concealment unit 400 may comprise a first transformer 402 for transforming the at least one monaural component in at least one history frame before the lost frame into a time-domain signal; a time-domain concealment unit 404 for concealing the packet loss with respect to the time-domain signal, resulting in a packet-loss-concealed time domain signal; and a first inverse transformer 406 for transforming the packet-loss-concealed time domain signal into the format of the at least one monaural component, resulting in a created monaural component corresponding to the at least one monaural component in the lost frame.

The time-domain concealment unit 404 may be realized with many existing techniques, including simple replicating time-domain signals in history or future frames, which are omitted here.

The transmission format discussed before is generally in the frequency domain. That is, $\widehat{Em}$ (p,k) is generally coded in the frequency domain. One example of the coding mechanism of the audio frames in transmission format, such as eigen channel components, is MDCT, which is a kind of overlapping transform, but the present application is not limited to overlapping transform but is also applicable to non-overlapping transform.

Figure 8:
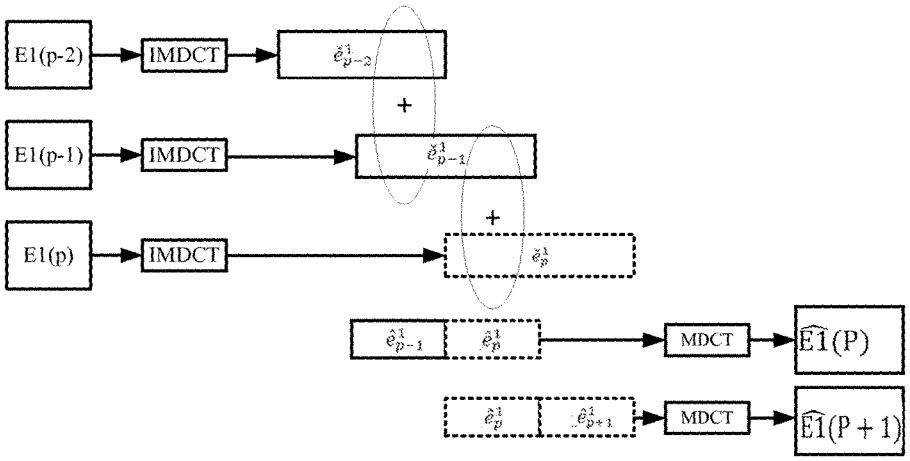
FIG. 8 is a diagram illustrating the principle of the variant shown in FIG. 7.

FIG. 8 shows, with an example of MDCT transform, the principle of the time domain PLC realized by the first concealment unit 400 in FIG. 7. As shown in FIG. 8, assuming packet E1(p) has been lost in transmission, first we can use the first transformer 402 (FIG. 7) to perform IMDCT to transform E1(p), E1(p−1) and E1(p−2) into time domain buffer $\check{e}_p^1$ (which is empty because E1(p) has been lost), $\check{e}_{p-1}^1$ and $\check{e}_{p-2}^1$. Then, the first transformer can use the second half of buffer $\check{e}_{p-2}^1$ and the first half of buffer $\check{e}_{p-1}$E1(p−1) to obtain the final time-domain signal $\hat{e}_{p-1}^1$. Similarily we can get the final time-domain signal $\hat{e}_p^1$. However, since E1(p) has been lost and thus $\check{e}_p^1$ is empty, $\hat{e}_p^1$, which should be an aliased time domain signal, contains only the second half of $\check{e}_{p-1}^1$. Fully synthesizing $\hat{e}_p^1$ needs PLC in time domain performed by the time-domain concealment unit 404 as mentioned above. That is, $\hat{e}_p^1$ may be subject to a time-domain PLC based on the time-domain signal $\hat{e}_{p-1}^1$. For simplicity and clarity, we still use the symbol $\hat{e}_p^1$ to represent packet-loss concealed time domain signal. Then, MDCT will be performed by the first inverse transformer 406 on $\hat{e}_{p-1}^1$ and $\hat{e}_p^1$ to get a newly created eigen channel component $\widehat{E1}$ (p).

Using the next packet-loss-concealed time domain buffer $\hat{e}_{p+1}^1$ and $\hat{e}_p^1$, $\widehat{E1}$ (p+1)E1 can be created via similar process if E1(p+1) has also been lost.

In the above example, for concealment of a lost frame, two previous frames are needed since the coding schema is an overlapping transform (MDCT). If a non-overlapping transform is involved, then the time-domain frames and the frequency domain frames will be in one-to-one correspondence. Then for concealment of a lost frame, one previous frame is enough.

For E2 and E3, similar PLC operation may be performed, but some other solutions are also provided in the present application, as will be discussed in the subsequent part.

Computational load of the PLC algorithm discussed above is relatively high. Therefore, in some cases, measures may be taken to lower the computational load. One is to predict E2 and E3 based on E1, as will be discussed later, the other is to mix the time domain PLC with other simpler ways.

For example, if multiple successive frames have been lost, then some lost frames, generally the first half of the lost frames, may be concealed with the time domain PLC while the other of the lost frames may be concealed with simpler way, such as replicating in frequency domain of the transmission format. Therefore, the first concealment unit 400 may be configured to create the at least one monaural component for at least one later lost frame by replicating the corresponding monaural component in an adjacent future frame, with or without an attenuation factor.

In the description above, we discussed both predictive coding/decoding of less important eigen channel components, and time domain PLC which may be used for any one of the eigen channel components. Although the time domain PLC is proposed for avoiding re-correlation in replication-based PLC for audio signals adopting predictive coding (such as predictive KLT coding), it may also be applied in other scenarios. For example, even for audio signals adopting non-predictive (discrete) coding, the time domain PLC may also be used.

Predictive PLC for Monaural Component

Figure 9A:
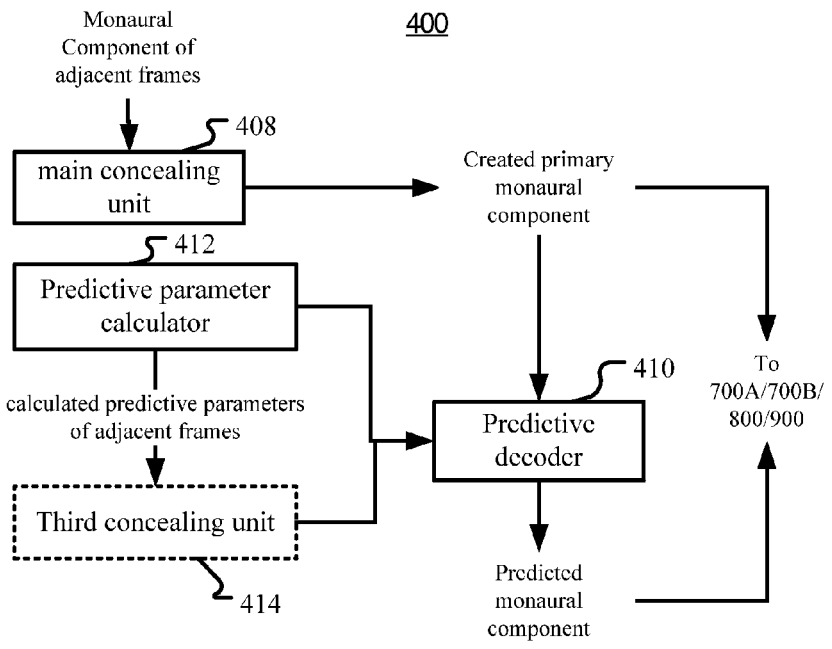
FIG. 9A is a diagram illustrating the first concealment unit 400 in FIG. 3 according to yet another variation of the embodiment in FIG. 3.
Figure 9B:
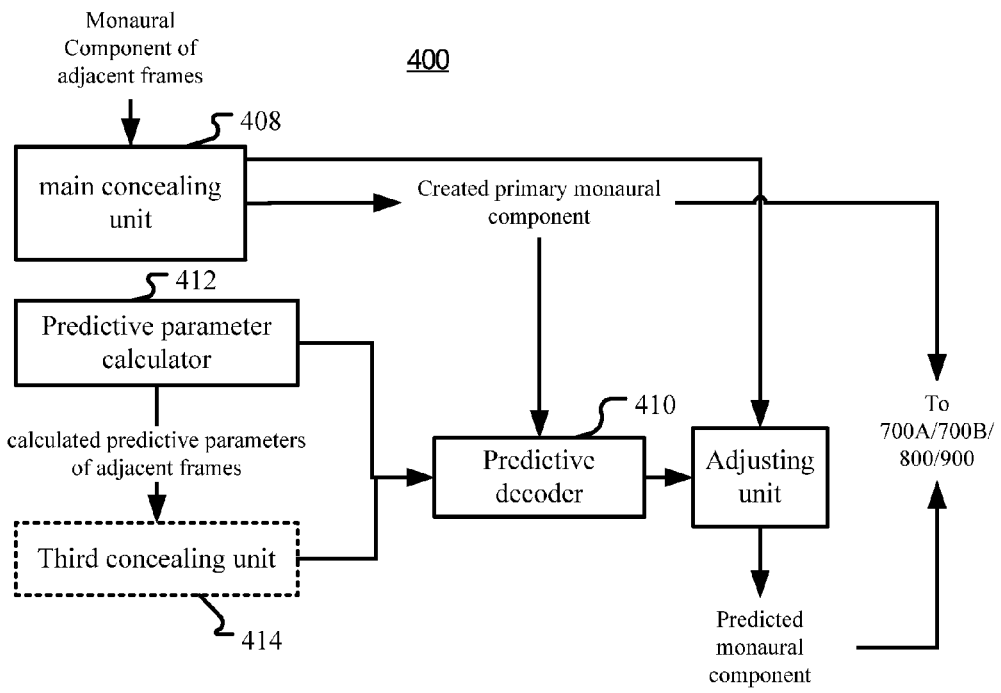
FIG. 9B is a diagram illustrating the first concealment unit 400 in FIG. 3 according to yet another variation of the embodiment in FIG. 3
Figure 10:
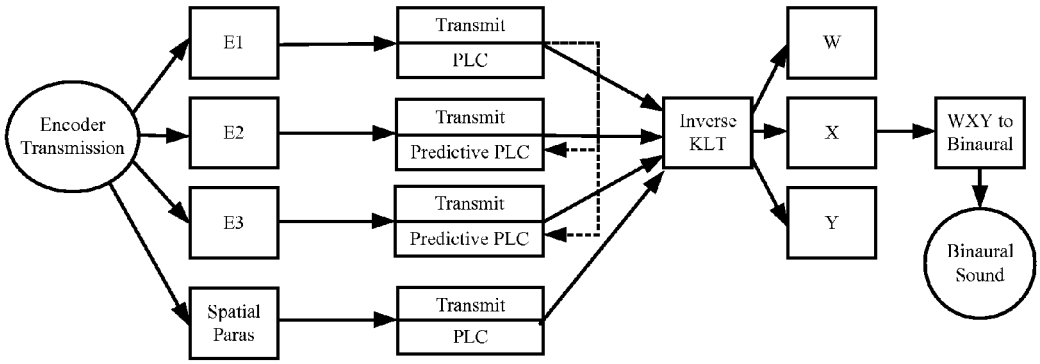
FIG. 10 is a diagram illustrating a specific example of the variation of the packet loss concealment apparatus in FIG. 9A.

In an embodiment shown in FIG. 9A, 9B and FIG. 10, discrete coding is adopted and thus each audio frame comprises at least two monaural components, such as E1, E2 and E3 (FIG. 10). Similar to FIG. 4, for a lost frame due to packet loss, all the eigen channel components have been lost and need be subject to the PLC process. As shown in the example of FIG. 10, the primary monaural component, such as the primary eigen channel component E1 may be created/restored with normal concealment schema such as replicating or other schemas discussed before including time domain PLC, while the other monaural components such as the less important eigen channel components E2 and E3 may be created/restored based on the primary monaural component (as shown with the dashed-line arrows in FIG. 10) with an approach which is similar to the predictive decoding as discussed in the previous part and thus may be called "predictive PLC". The other parts in FIG. 10 are similar to those in FIG. 4 and thus the detailed description thereof is omitted here.

Specifically, the following variants of formulae (5), (5') and (5") may be used to predict the less important monaural components, with an attenuation factor g added or not added:

$$\widehat{Em}(p,k)=\widehat{am}(p,k)*\widehat{E1}(p,k)+g*\widehat{bm}(p,k)*dm(\widehat{E1}(p,k)) \quad (5\text{-}1)$$

where $\widehat{Em}$ (p,k) is a predicted monaural component for a lost frame that is the $p^{th}$ frame, k is the frequency bin number, and m may be 2 or 3 assuming there are 3 eigen channel components but the present application is not limited thereto. $\widehat{E1}$ (p,k) is the primary monaural component created by the main concealment unit 408. dm($\widehat{E1}$ (p,k)) is the decorrelated version of $\widehat{E1}$ (p,k). $\widehat{am}$ (p,k) and $\widehat{bm}$ (p,k) are predictive parameters for corresponding monaural components. The value range of g may be (0.5,1], when g=1, it is equivalent to using no attenuation factor.

The decorrelated version of $\widehat{E1}$ (p,k) may be calculated in various ways in the art. One way is to take the monaural component in a history frame corresponding to the created one monaural component for the lost frame as the decorrelated version of the created one monaural component, no matter whether the monaural component in the history frame is normally transmitted or is created by the main concealment unit 408. That is:

$$\widehat{E1}(p,k)=\widehat{am}(p,k)*\widehat{E1}(p,k)+g*\widehat{bm}(p,k)*\widehat{E1}(p-m+1,k) \quad (5'\text{-}1)$$

Or:

$$\widehat{E1}(p,k)=\widehat{am}(p,k)*\widehat{E1}(p,k)+g*\widehat{bm}(p,k)*E1(p-m+1,k) \quad (5''\text{-}1)$$

where E1(p−m+1,k) is the normally transmitted primary monaural component in a history frame, that is the $(p-m+1)^{th}$ frame. While $\widehat{E1}$ (p−m+1,k) is a restored (created) monaural component for the history frame (which has been lost). Note that here we use a history frame determined based on the sequential number of the monaural component, meaning that for a less important monaural component such as eigen channel component (eigen channel components are sequenced based on their importance), an earlier frame will be used. But the present application is not limited thereto.

A problem for non-predictive/discrete coding is there are no predictive parameters even for normally transmitted adjacent frames. Therefore, the predictive parameters need be obtained through other ways. In the present application, they may be calculated based on the monaural components of a history frame, generally the last frame, whether or not the history frame or the last frame is normally transmitted or restored with PLC.

Therefore, according to the embodiment, the first concealment unit 400 may comprise, as shown in FIG. 9, a main concealment unit 408 for creating one of the at least two monaural components for the lost frame, a predictive parameter calculator 412 for calculating at least one predictive parameter for the lost frame using a history frame, and a predictive decoder 410 for predicting at least one other monaural component of the at least two monaural components of the lost frame based on the created one monaural component using the created at least one predictive parameter.

The main concealment unit 408 and the predictive decoder 410 are similar to those in FIG. 5 and detailed description thereof has been omitted here.

The predictive parameter calculator 412 may be realized with any techniques, while in a variant of the embodiment, it is proposed to calculate the predictive parameters by using the last frame before the lost frame. The following formulae present a specific example, which however shall not limit the present application:

$$\widehat{am}(p,k)=(E1^T(p-1,k)*Em(p-1,k))/(E1^T(p-1,k)*E1(p-1,k)) \quad (9)$$

$$\widehat{bm}(p,k)=\mathrm{norm}(Em(p-1,k)-\widehat{am}(p,k)*E1(p-1,k))/\mathrm{norm}(E1(p-1,k)) \quad (10)$$

where the symbols have the same meaning as before, norm( ) indicates the RMS (root mean squared) operation, and the superscript T represents matrix transpose. Note that formula (9) corresponds to formulae (19) and (20) in the part "Forward and Inverse Adaptive Transform of Audio Signal", and formula (10) corresponds to formulae (21) and (22) in the same part. The difference is, formulae (19)-(22) are used in the encoding side, and thus the predictive parameters are calculated based on the eigen channel components of the same frame; while formulae (9) and (10) are used in the decoding side for predictive PLC, specifically for "predicting" less important eigen channel components from the created/restored primary eigen channel components, therefore the predictive parameters are calculated from the eigen channel components of the previous frame (whether normally transmitted or created/restored during PLC), and the symbol is used. Anyway, the basic principles formulae (9) and (10) and formulae (19)-(22) are similar, and for details thereof and more variations thereof please refer to the part "Forward and Inverse Adaptive Transform of Audio Signal", including the "ducker" style energy adjustment to be mentioned below. Based on the same rule as described above with respect to the difference between formulae, the other solutions or formulae described in the part "Forward and Inverse Adaptive Transform of Audio Signal" may be applied in the predictive PLC as described in this part. Simply speaking, the rule is: generating the predictive parameter(s) for a previous frame (such as the last frame), and using them as the predictive parameters for predicting the less important monaural component(s) (eigen channel components) for a lost frame.

In other words, the predictive parameter calculator 412 may be implemented in a manner similar to the parametric encoding unit 104 as will be described later.

For avoiding abrupt fluctuation of the estimated parameters, the predictive parameters estimated above may be smoothed using any techniques. In a specific example, a "ducker" style energy adjustment may be done, which is represented by duck( ) in the formula below, so as to avoid level of concealed signal changing so quickly, especially in transitional areas between voice and silence, or speech and music.

$$\widehat{bm}\,\mathrm{new}(p,k)=\mathrm{duck}(\widehat{bm}(p,k)) \tag{11}$$
$$=\widehat{bm}(p,k)*norm(E1(p-1,k))/\max\{norm(E1(p-1,k)),\ \lambda*(norm(E1(p-m,k))-norm(E1(p-1,k))\}$$

Where $1.0<\lambda<2.0$, $m\in\{2, 3\}$. Similar to formulae (9) and (10), formula (11) corresponds to formulae (32) and (33).

The formula (11) may also be replaced with a simpler version (corresponding to formulae (36) and (37)):

$$\widehat{bm}\,\mathrm{new}(p,k)=\widehat{bm}(p,k)*\min\{1,\mathrm{norm}(E1(p-1,k))/\mathrm{norm}(E1(p-m,k))\} \tag{12}$$

In the embodiment discussed above, for each lost frame the predictive parameter(s) may be calculated by the predictive parameter calculator 412 to be used by the predictive decoder 410, whether or not the basis for calculating the predictive parameter calculator 412, that is the used history frame, is a normally transmitted frame or a lost then restored (created) frame.

Above a brief description is given about the calculation of the predictive parameters, but the present application is not limited thereto. Actually, more variations may be envisaged with reference to those algorithms discussed in the part "Forward and Inverse Adaptive Transform of Audio Signal".

In a variant, a third concealment unit 414 similar to that discussed in the previous part and used for concealing lost predictive parameters in predictive coding schema may be further comprised, as shown in FIG. 9A. Then, if at least one predictive parameter has been calculated for the last frame before the lost frame, then the third concealment unit 414 may create the at least one predictive parameter for the lost frame based on the at least one predictive parameter for the last frame. Note that the solution shown in FIG. 9A may also be applied for predictive coding schema. That is, the solution in FIG. 9A is commonly applicable to both predictive and non-predictive coding schema. For predictive coding schema (thus predictive parameter(s) exist in normally transmitted history frames), the third concealment unit 414 operates; for the first lost frame (without adjacent history frames having predictive parameters) in non-predictive coding schema, the predictive parameter calculator 412 operates; while for lost frame(s) subsequent to the first lost frame in non-predictive coding schema, either predictive parameter 412 or the third concealment unit 414 may operate.

Therefore, in FIG. 9A, the predictive parameter calculator 412 may be configured to calculate the at least one predictive parameter for the lost frame using the previous frame when no predictive parameter is contained in or has been created/calculated for the last frame before the lost frame, and the predictive decoder 410 may be configured to predict the at least one other monaural component of the at least two monaural components for the lost frame based on the created one monaural component using the calculated or created at least one predictive parameter.

As discussed before, the third concealment unit 414 may be configured to create the at least one predictive parameter for the lost frame by replicating the corresponding predictive parameter in the last frame with or without an attenuation factor, smoothing the values of corresponding predictive parameter of adjacent frame(s), or interpolation using the values of corresponding predictive parameter in history and future frames.

In a further variant as shown in FIG. 9B, predictive PLC discussed in this part and non-predictive PLC (such as those discussed in the part "Overall Solutions", including simple replicating or the PLC schema discussed with reference to FIG. 7, etc.) may be combined. That is, for a less important monaural component, both non-predictive PLC and predictive PLC may be conducted, the obtained results are combined to obtain the final created monaural component, such as a weighted average of the two results. This process may also be regarded as adjusting one result with the other result, and the weighting factor would determine which one is dominant and may be set depending on specific scenarios.

Therefore, as shown in FIG. 9B, in the first concealment unit 400, the main concealment unit 408 may be further configured to create the at least one other monaural component, and the first concealment unit 400 further comprises an adjusting unit 416 for adjusting the at least one other monaural component predicted by the predictive decoder 410 with the at least one other monaural component created by the main concealment unit 408.

PLC for Spatial Component

In the part "Overall Solutions", PLC for spatial components such as spatial parameters d, φ, θ has been discussed. Stability of spatial parameters is critical in maintaining perceptual continuity. This is achieved through smoothing the parameters directly in the part "Overall Solutions". As another independent solution, or as a supplemental aspect to the PLC discussed in the part "Overall Solutions", smoothing operations on the spatial parameters may be performed on the coding side. Thus, since the spatial parameters have been smoothed on the coding side, then on the decoding side, the result of PLC with respect to the spatial parameters would be smoother and more stable.

Similarly, the smoothing operation may be conducted directly on the spatial parameters. While in the present application, it is further proposed to smooth the spatial parameters by smoothing the elements of the transform matrix originating the spatial parameters.

As discussed in the part "Overall Solutions", the monaural components and the spatial components may be derived with adaptive transform and one important example is the KLT as already discussed. In such a transform, the input format (such as WXY or LRS) may be transformed into rotated audio signals (such as eigen channel components in KLT coding) through a transform matrix such as a covariance matrix in KLT coding. And the spatial parameters d, φ, θ are derived from the transform matrix. So, if the transform matrix is smoothed, then the spatial parameter would be smoothed.

Again, various smoothing operations are applicable, such as moving average or history average shown below:

$$Rxx_\mathrm{smooth}(p)=\alpha*Rxx_\mathrm{smooth}(p-1)+(1-\alpha)*Rxx(p) \tag{13}$$

where Rxx_smooth(p) is the transform matrix of the frame p after smoothing, Rxx_smooth(p−1) is the transform matrix of the frame p−1 after smoothing, Rxx(p) is the transform matrix of the frame p before smoothing. α is a weighting factor has a range of (0.8,1], or adaptively produced based on other physical property like diffuseness of frame p.

Figure 11:
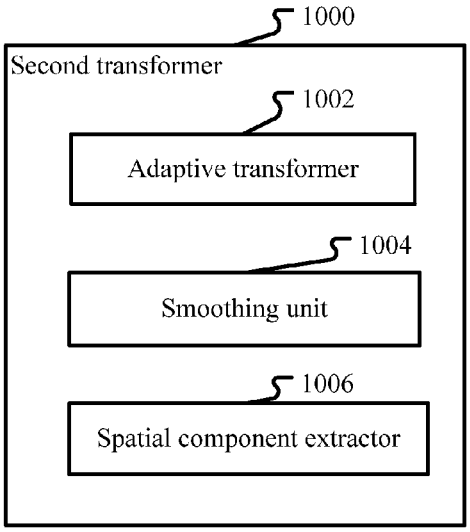
FIG. 11 is a diagram illustrating a second transformer in a communication terminal according to another embodiment of the application.

Therefore, as shown in FIG. 11, a second transformer 1000 for transforming a spatial audio signal of input format into frames in transmission format is provided. Here each frame comprises at least one monaural component and at least one spatial component. The second transformer may comprise an adaptive transformer 1002 for decomposing each frame of the spatial audio signal of input format into at least one monaural component, which is associated with the frame of the spatial audio signal of input format through a transform matrix; a smoothing unit 1004 for smoothing the values of each element in the transform matrix, resulting in a smoothed transform matrix for the present frame; and a spatial component extractor 1006 for diriving the at least one spatial component from the smoothed transform matrix.

With a smoothed covariance matrix, the stability of spatial parameters can be significantly improved. This allows simple replication of spatial parameters as an efficient, yet effective approach in the context of PLC, as discussed in the part "Overall Solutions".

More details about smoothing of the covariance matrix and deriving the spatial parameters there from will be given in the part "Forward and Inverse Adaptive Transform of Audio Signal".

Forward and Inverse Adaptive Transform of Audio Signal

This part is to give some examples on how to obtain the audio frames in transmission format, such as parametric eigen signals, serving as an example audio signal as the processing object of the present application, and corresponding audio encoders and decoders. However, the present application definitely is not limited thereto. The PLC apparatus and methods discussed above may be placed and implemented before the audio decoder, such as in a server, or integrated with the audio decoder, such as in a destination communication terminal.

For describing this part more clearly, some terms are not completely the same as those used in previous parts, but the correspondence will be given where appropriate below. Two-dimensional spatial sound fields are typically captured by a 3-microphone array ("LRS") and then represented in the 2-dimensional B format ("WXY"). The 2-dimensional B format ("WXY") is an example of a sound field signal, in particular an example of a 3-channel sound field signal. A 2-dimensional B format typically represents sound fields in the X and Y directions, but does not represent sound fields in a Z direction (elevation). Such 3-channel spatial sound field signals may be encoded using a discrete and a parametric approach. The discrete approach has been found to be efficient at relatively high operating bit-rates, while the parametric approach has been found to be efficient at relatively low rates (e.g. at 24 kbit/s or less per channel). In the present part a coding system is described which uses a parametric approach.

The parametric approaches have an additional advantage with respect to a layered transmission of sound field signals. The parametric coding approach typically involves the generation of a down-mix signal and the generation of spatial parameters which describe one or more spatial signals. The parametric description of the spatial signals, in general, requires a lower bit-rate than the bit-rate required in a discrete coding scenario. Therefore, given a pre-determined bit-rate constraint, in the case of parametric approaches, more bits can be spent for discrete coding of a down-mix signal from which a sound field signal may be reconstructed using the set of spatial parameters. Hence, the down-mix signal may be encoded at a bit-rate which is higher than the bit-rate used for coding each channel of a sound field signal separately. Consequently, the down-mix signal may be provided with an increased perceptual quality. This feature of the parametric coding of spatial signals is useful in applications involving layered coding, where mono clients (or terminals) and spatial clients (or terminals) coexist in a teleconferencing system. For example, in case of a mono client, the down-mix signal may be used for rendering a mono output (ignoring the spatial parameters which are used to reconstruct the complete sound field signal). In other words, a bit-stream for a mono client may be obtained by stripping off the bits from the complete sound field bit-stream which are related to the spatial parameters.

The idea behind the parametric approach is to send a mono down-mix signal plus a set of spatial parameters that allow reconstructing a perceptually appropriate approximation of the (3-channel) sound field signal at the decoder. The down-mix signal may be derived from the to-be-encoded sound field signal using a non-adaptive down-mixing approach and/or an adaptive down-mixing approach.

The non-adaptive methods for deriving the down-mix signal may comprise the usage of a fixed invertible transformation. An example of such a transformation is a matrix that converts the "LRS" representation into the 2-dimensional B format ("WXY"). In this case, the component W may be a reasonable choice for the down-mix signal due to the physical properties of the component W. It may be assumed that the "LRS" representation of the sound field signal was captured by an array of 3 microphones, each having a cardioid polar pattern. In such a case, the W component of the B-format representation is equivalent to a signal captured by a (virtual) omnidirectional microphone. The virtual omnidirectional microphone provides a signal that is substantially insensitive to the spatial position of the sound source, thus it provides a robust and stable down-mix signal. For example, the angular position of the primary sound source which is represented by the sound field signal does not affect the W component. The transformation to the B-format is invertible and the "LRS" representation of the sound field can be reconstructed, given "W" and the two other components, namely "X" and "Y". Therefore, the (parametric) coding may be performed in the "WXY" domain. It should be noted that in more general term the above mentioned "LRS" domain may be referred to as the captured domain, i.e. the domain within which the sound field signal has been captured (using a microphone array).

An advantage of parametric coding with a non-adaptive down-mix is due to the fact that such a non-adaptive approach provides a robust basis for prediction algorithms performed in the "WXY" domain because of the stability and robustness of the down-mix signal. A possible disadvantage of parametric coding with a non-adaptive down-mix is that the non-adaptive down-mix is typically noisy and carries a lot of reverberation. Thus, prediction algorithms which are performed in the "WXY" domain may have a reduced performance, because the "W" signal typically has different characteristics than the "X" and "Y" signals.

The adaptive approach to creating a down-mix signal may comprise performing an adaptive transformation of the "LRS" representation of the sound field signal. An example for such a transformation is the Karhunen-Loève transform (KLT). The transformation is derived by performing the eigenvalue decomposition of the inter-channel covariance matrix of the sound field signal. In the discussed case, the inter-channel covariance matrix in the "LRS" domain may be used. The adaptive transformation may then be used to transform the "LRS" representation of the signal into the set of eigen-channels, which may be denoted by "E1 E2 E3". High coding gains may be achieved by applying coding to the "E1 E2 E3" representation. In the case of a parametric coding approach, the "E1" component could serve as the mono-down-mix signal.

An advantage of such an adaptive down-mixing scheme is that the eigen-domain is convenient for coding. In principle, an optimal rate-distortion trade-off can be achieved when encoding the eigen-channels (or eigen-signals). In the idealistic case, the eigen-channels are fully decorrelated and they can be coded independently from one another with no performance loss (compared to a joint coding). In addition, the signal E1 is typically less noisy than the "W" signal and typically contains less reverberation. However, the adaptive down-mixing strategy has also disadvantages. A first disadvantage is related to the fact that the adaptive down-mixing transformation must be known by the encoder and by the decoder, and, therefore, parameters which are indicative of the adaptive down-mixing transformation must be coded and transmitted. In order to achieve the goal with respect to decorrelation of the eigen-signals E1, E2 and E3, the adaptive transformation should be updated at a relatively high frequency. The regular update of the adaptive transmission leads to an increase in computational complexity and requires a bit-rate to transmit a description of the transformation to the decoder.

A second disadvantage of the parametric coding based on the adaptive approach may be due to instabilities of the E1-based down-mix signal. The instabilities may be due to the fact that the underlying transformation that provides the down-mix signal E1 is signal-adaptive and therefore the transformation is time varying. The variation of the KLT typically depends on the spatial properties of the signal sources. As such, some types of input signals may be particularly challenging, such as multiple talkers scenarios, where multiply talkers are represented by the sound field signal. Another source of instabilities of the adaptive approach may be due to the spatial characteristic of the microphones that are used to capture the "LRS" representation of the sound field signal. Typically, directive microphone arrays having polar patterns (e.g., cardioids) are used to capture the sound field signals. In such cases, the inter-channel covariance matrix of the sound field signal in the "LRS" representation may be highly variable, when the spatial properties of the signal source change (e.g., in a multiple talkers scenario) and so would be the resulting KLT.

In the present document, a down-mixing approach is described, which addresses the above mentioned stability issues of the adaptive down-mixing approach. The described down-mixing scheme combines the advantages of the non-adaptive and the adaptive down-mixing methods. In particular, it is proposed to determine an adaptive down-mix signal, e.g. a "beamformed" signal that contains primarily the dominating component of the sound field signal and that maintains the stability of the down-mixing signal derived using a non-adaptive down-mixing method.

It should be noted that the transformation from the "LRS" representation to the "WXY" representation is invertible, but it is non-orthonormal. Therefore, in the context of coding (e.g. due to quantization), application of the KLT in the "LRS" domain and application of KLT in the "WXY" domain are usually not equivalent. An advantage of the WXY representation relates to the fact that it contains the component "W" which is robust from the point of view of the spatial properties of the sound source. In the "LRS" representation all the components are typically equally sensitive to the spatial variability of the sound source. On the other hand, the "W" component of the WXY representation is typically independent of the angular position of the primary sound source within the sound field signal.

It can further be stated that regardless the representation of the sound field signals, it is beneficial to apply the KLT in a transformed domain, where at least one component of the sound field signal is spatially stable. As such, it may be beneficial to transform a sound field representation to a domain, where at least one component of the sound field signal is spatially stable. Subsequently, an adaptive transformation (such as the KLT) may be used in the domain, where at least one component signal is spatially stable. In other words, the usage of a non-adaptive transformation that depends only on the properties of the polar patterns of the microphones of the microphone array which is used to capture the sound field array is combined with an adaptive transformation that depends on the inter-channel time-varying covariance matrix of the sound field signal in the non-adaptive transform domain. We note that both transformations (i.e. the non-adaptive and the adaptive transformation) are invertible. In other words, the benefit of the proposed combination of the two transforms is that the two transforms are both guaranteed to be invertible in any case, and, therefore the two transforms allow for an efficient coding of the sound field signal.

As such, it is proposed to transform a captured sound field signal from the captured domain (e.g. the "LRS" domain) to a non-adaptive transform domain (e.g. the "WXY" domain). Subsequently, an adaptive transform (e.g. a KLT) may be determined based on the sound field signal in the non-adaptive transform domain. The sound field signal may be transformed into the adaptive transform domain (e.g. the "E1E2E3" domain) using the adaptive transform (e.g. the KLT).

In the following, different parametric coding schemes are described. The coding schemes may use a prediction-based and/or a KLT-based parameterizations. The parametric coding schemes are combined with the above mentioned down-mixing schemes, aiming at improving the overall rate-quality trade-off of the codec.

Figure 22:
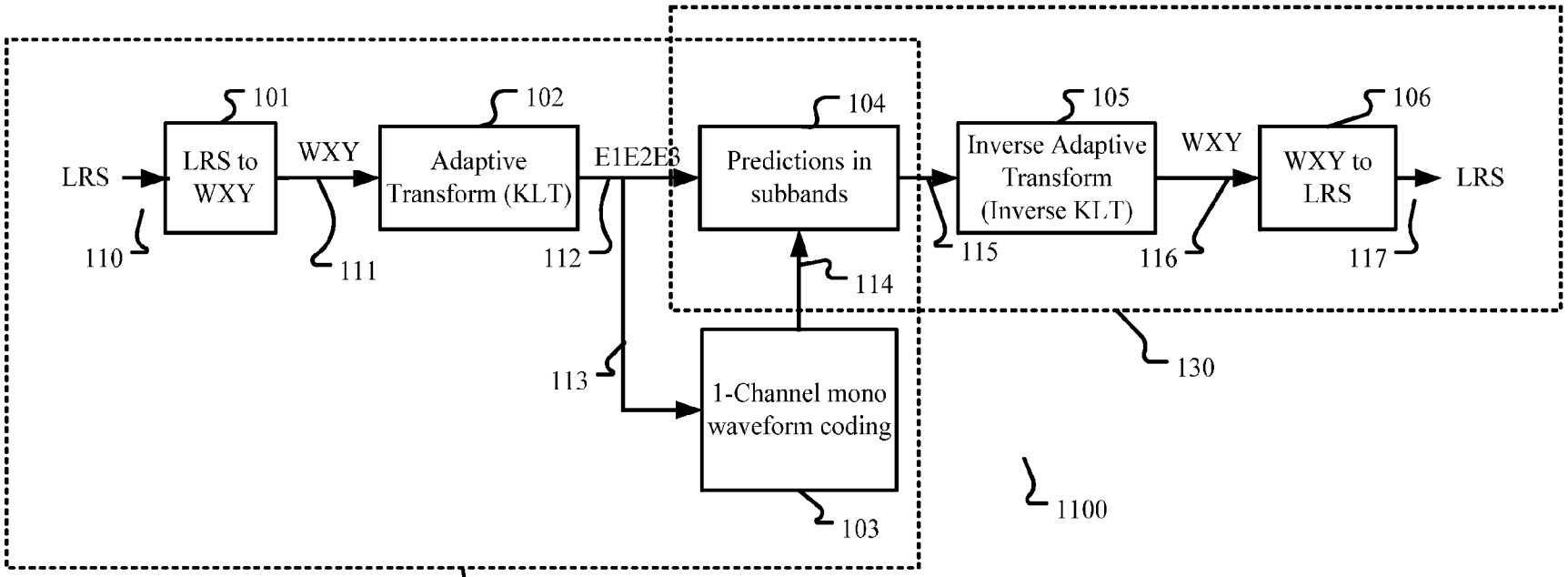
FIG. 22 shows a block diagram of an example sound field coding system.

FIG. 22 shows a block diagram of an example coding system 1100. The illustrated system 1100 comprises components 120 which are typically comprised within an encoder of the coding system 1100 and components 130 which are typically comprised within a decoder of the coding system 1100. The coding system 1100 comprises an (invertible and/or non-adaptive) transformation 101 from the "LRS" domain to the "WXY" domain, followed by an energy concentrating orthonormal (adaptive) transformation (e.g. the KLT transform) 102. The sound field signal 110 in the domain of the capturing microphone array (e.g. the "LRS" domain) is transformed by the non-adaptive transform 101 into a sound field signal 111 in a domain which comprises a stable down-mix signal (e.g. the signal "W" in the "WXY" domain). Subsequently, the sound field signal 111 is transformed using the decorrelating transform 102 into a sound field signal 112 comprising decorrelated channels or signals (e.g. the channels E1, E2, E3).

The first eigen-channel E1 113 may be used to encode parametrically the other eigen-channels E2 and E3 (parametric coding, also called as "predictive coding" in previous parts). But the present application is not limited thereto. In another embodiment, E2 and E3 may not be encoded parametrically, but are just encoded as the same manner of E1 (discrete approach, also called as "non-predictive/discrete coding" in previous parts). The down-mix signal E1 may be coded using a single-channel audio and/or speech coding scheme using the down-mix coding unit 103. The decoded down-mix signal 114 (which is also available at the corresponding decoder) may be used to parametrically encode the eigen-channels E2 and E3. The parametric coding may be performed in the parametric coding unit 104. The parametric coding unit 104 may provide a set of predictive parameters which may be used to reconstruct the signals E2 and E3 from the decoded signal E1 114. The reconstruction is typically performed at the corresponding decoder. Furthermore, the decoding operation comprises usage of the reconstructed E1 signal and the parametrically decoded E2 and E3 signals (reference numeral 115) and comprises performing an inverse orthonormal transformation (e.g. an inverse KLT) 105 to yield a reconstructed sound field signal 116 in the non-adaptive transform domain (e.g. the "WXY" domain). The inverse orthonormal transformation 105 is followed by a transformation 106 (e.g. the inverse non-adaptive transform) to yield the reconstructed sound field signal 117 in the captured domain (e.g. the "LRS" domain). The transformation 106 typically corresponds to the inverse transformation of the transformation 101. The reconstructed sound field signal 117 may be rendered by a terminal of the teleconferencing system, which is configured to render sound field signals. A mono terminal of the teleconferencing system may directly render the reconstructed down-mix signal E1 114 (without the need of reconstructing the sound field signal 117).

In order to achieve an increased coding quality, it is beneficial to apply parametric coding in a sub-band domain. A time domain signal can be transformed to the sub-band domain by means of a time-to-frequency (T-F) transformation, e.g. an overlapped T-F transformation such as, for example, MDCT (Modified Discrete Cosine Transform). Since the transformations 101, 102 are linear, the T-F transformation, in principle, can be equivalently applied in the captured domain (e.g. the "LRS" domain), in the non-adaptive transform domain (e.g. the "WXY" domain) or in the adaptive transform domain (e.g. the "E1 E2 E3" domain). As such, the encoder may comprise a unit configured to perform a T-F transformation (e.g. unit 201 in FIG. 2*a*).

The description of a frame of the 3-channel sound field signal 110 that is generated using the coding system 1100 comprises e.g. two components. One component comprises parameters that are adapted at least on a per-frame basis. The other component comprises a description of a monophonic waveform that is obtained based on the down-mix signal 113 (e.g. E1) by using a 1-channel mono coder (e.g. a transform based audio and/or speech coder).

The decoding operation comprises decoding of the 1-channel mono down-mix signal (e.g. the E1 down-mix signal). The reconstructed down-mix signal 114 is then used to reconstruct the remaining channels (e.g. the E2 and E3 signals) by means of the parameters of the parameterization (e.g. by means of predictive parameters). Subsequently, the reconstructed eigen-signals E1 E2 and E3 115 are rotated back to the non-adaptive transform domain (e.g. the "WXY" domain) by using transmitted parameters which describe the decorrelating transformation 102 (e.g. by using the KLT parameters). The reconstructed sound field signal 117 in the captured domain may be obtained by transforming the "WXY" signal 116 to the original "LRS" domain 117.

Figure 23A:
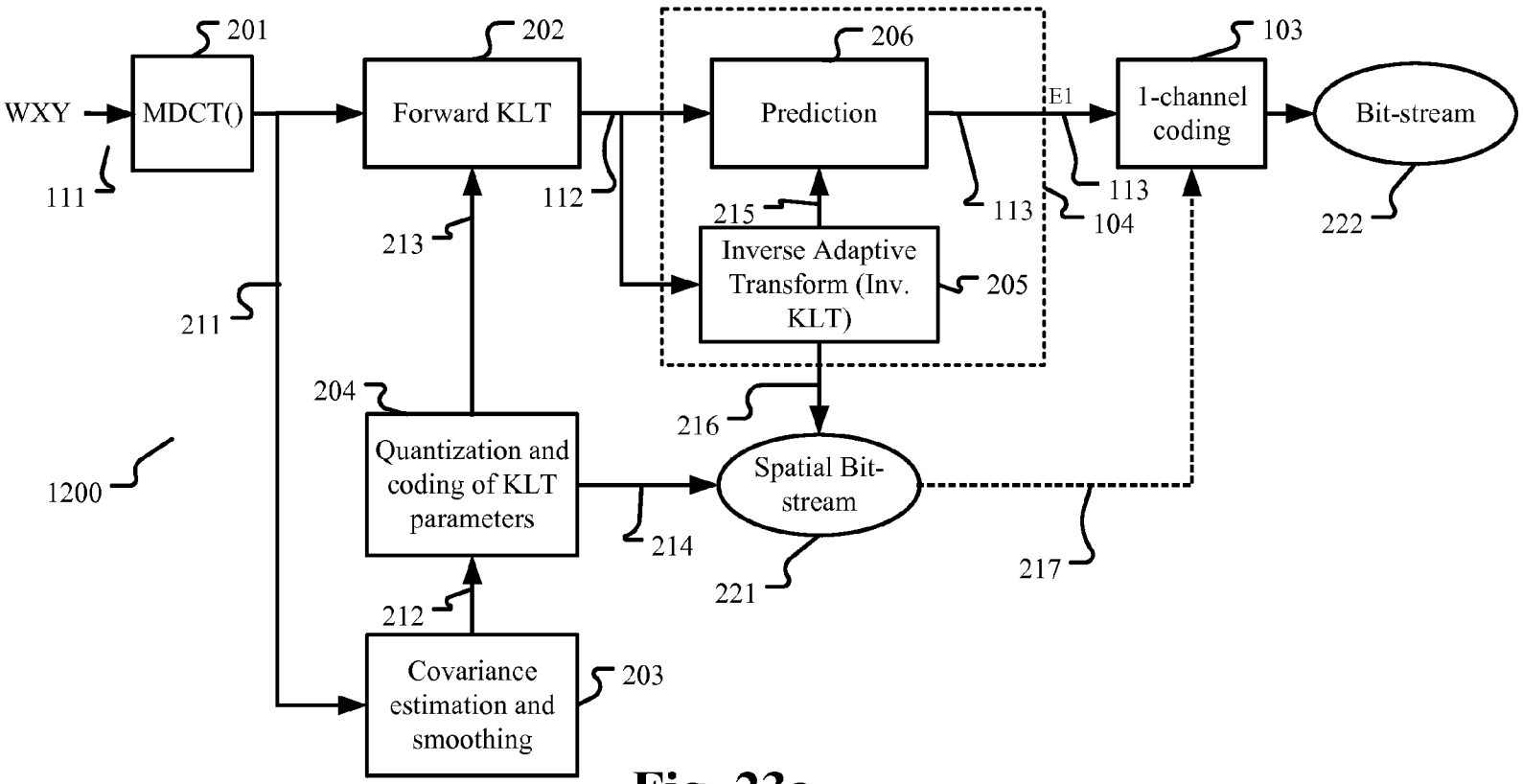
FIG. 23*a* shows a block diagram of an example sound field encoder.
Figure 23B:
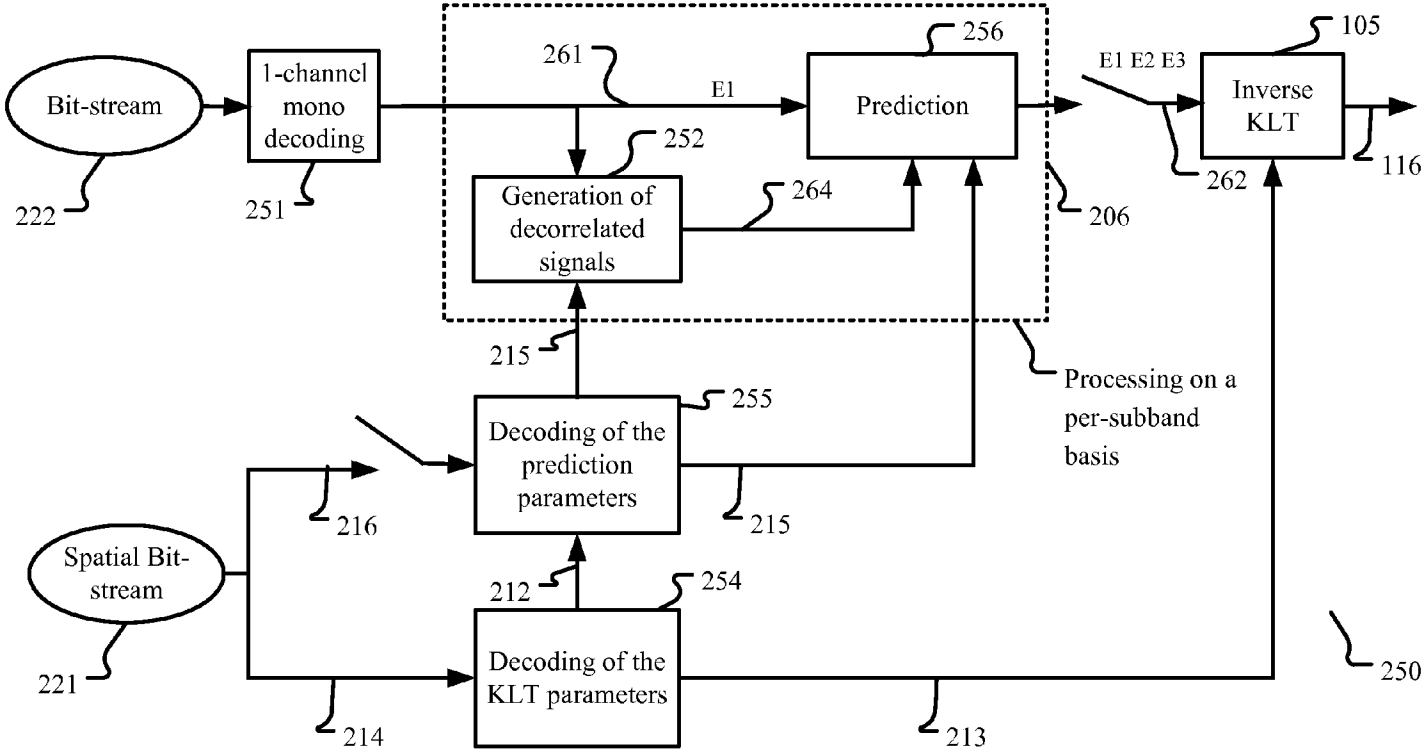
FIG. 23*b* shows a block diagram of an example sound field decoder.

FIGS. 23*a* and 23*b* show block diagrams of an example encoder 1200 and of an example decoder 250, respectively, in more detail. In the illustrated example, the encoder 1200 comprises a T-F transformation unit 201 which is configured to transform the (channels of the) sound field signal 111 within the non-adaptive transform domain into the frequency domain, thereby yielding sub-band signals 211 for the sound field signal 111. As such, in the illustrated example, the transformation 202 of the sound field signal 111 into the adaptive transform domain is performed on the different sub-band signals 211 of the sound field signal 111.

In the following, the different components of the encoder 1200 and of the decoder 250 are described.

As outlined above, the encoder 1200 may comprise a first transformation unit 101 configured to transform the sound field signal 110 from the captured domain (e.g. the "LRS" domain) into a sound field signal 111 in the non-adaptive transform domain (e.g. the "WXY" domain). A transformation from the "LRS" domain to the "WXY" domain may be performed by the transformation $[W \times Y]^T = M(g)\ [L\ R\ S]^T$, with the transform matrix M(g) given by $$M(g) = \frac{1}{3}\begin{bmatrix} 2g & 2g & 2g \\ 2 & 2 & -4 \\ 2\sqrt{3} & -2\sqrt{3} & 0 \end{bmatrix}, \tag{13}$$

where g>0 is a finite constant. If g=1, a proper "WXY" representation is obtained (i.e., according to the definition of the 2-dimensional B-format), however other values g may be considered.

The KLT 102 provides rate-distortion efficiency if it can be adapted often enough with respect to the time varying statistical properties of the signals it is applied to. However, frequent adaptation of the KLT may introduce coding artifacts that degrade the perceptual quality. It has been determined experimentally that a good balance between rate-distortion efficiency and the introduced artifacts is obtained by applying the KLT transform to the sound field signal 111 in the "WXY" domain instead of applying the KLT transform to the sound field signal 110 in the "LRS" domain (as already outlined above).

The parameter g of the transform matrix M(g) may be useful in the context of stabilizing the KLT. As outlined above, it is desirable for the KLT to be substantially stable. By selecting g≠sqrt(2), the transform matrix M(g) is not be orthogonal and the W component is emphasized (if g>sqrt(2)) or deemphasized (if g<sqrt(2)). This may have a stabilizing effect on the KLT. It should be noted that for any g≠0 the transform matrix M(g) is always invertible, thus facilitating coding (due to the fact that the inverse matrix $M^{-1}(g)$ exists and can be used at the decoder 250). However, if g≠sqrt(2) the coding efficiency (in terms of the rate-distortion trade-off) typically decreases (due to the non-orthogonality of the transform matrix M(g)). Therefore, the parameter g should be selected to provide an improved trade-off between the coding efficiency and the stability of the KLT. In the course of experiments, it was determined that g=1 (and thus a "proper" transformation to the "WXY" domain) provides a reasonable trade-off between the coding efficiency and the stability of the KLT.

In the next step, the sound field signals 111 in the "WXY" domain are analysed. First, the inter-channel covariance matrix may be estimated using a covariance estimation unit 203. The estimation may be performed in the sub-band domain (as illustrated in FIG. 23*a*). The covariance estimator 203 may comprise a smoothing procedure that aims at improving estimation of the inter-channel covariance and at reducing (e g minimizing) possible problems caused by substantial time variability of the estimate. As such, the covariance estimation unit 203 may be configured to perform a smoothing of the covariance matrix of a frame of the sound field signal 111 along the time line.

Furthermore, the covariance estimation unit 203 may be configured to decompose the inter-channel covariance matrix by means of an eigenvalue decomposition (EVD) yielding an orthonormal transformation V that diagonalizes the covariance matrix. The transformation V facilitates rotation of the "WXY" channels into an eigen-domain comprising the eigen-channels "E1 E2 E3" according to $$\begin{bmatrix} E1 \\ E2 \\ E3 \end{bmatrix} = V \begin{bmatrix} W \\ X \\ Y \end{bmatrix}. \tag{14}$$

Since the transformation V is signal adaptive and it is inverted at the decoder 250, the transformation V needs to be efficiently coded. In order to code the transformation V the following parameterization is proposed:

$$V(d, \varphi, \theta) = \left[\begin{bmatrix} c(1-d) & 0 & cd \\ cd\cos\varphi & -\sin\varphi & -c(1-d)\cos\varphi \\ cd\sin\varphi & \cos\varphi & -c(1-d)\sin\varphi \end{bmatrix} \begin{bmatrix} 1 & 0 & 0 \\ 0 & \cos\theta & -\sin\theta \\ 0 & \sin\theta & \cos\theta \end{bmatrix}\right]^T, \tag{15}$$

wherein $c=1/\sqrt{(1-d)^2+d^2}$ and the parameters d, φ, θ specify the transformation. It is noted that the proposed parameterization imposes a constraint on the sign of the (1,1) element of the transformation V (i.e. the (1,1) element always needs to be positive). It is advantageous to introduce such a constraint and it can be shown that such a constraint does not result in any performance loss (in terms of achieved coding gain). The transformation V(d, φ, θ) which is described by the parameters d, φ, θ is used within the transform unit 202 at the encoder 1200 (FIG. 23*a*) and within the corresponding inverse transform unit 105 at the decoder 250 (FIG. 23*b*). Typically, the parameters d, φ, θ are provided by the covariance estimation unit 203 to a transform parameter coding unit 204 which is configured to quantize and (Huffman) encode the transform parameters d, φ, θ 212. The encoded transform parameters 214 may be inserted into a spatial bit-stream 221. A decoded version of the encoded transform parameters 213 (which corresponds to the decoded transform parameters 213 $\hat{d}$, $\hat{\varphi}$, $\hat{\theta}$ at the decoder 250) is provided to the decorrelation unit 202, which is configured to perform the transformation:

$$\begin{bmatrix} E1 \\ E2 \\ E3 \end{bmatrix} = V(\hat{d}, \hat{\varphi}, \hat{\theta}) \begin{bmatrix} W \\ X \\ Y \end{bmatrix} \tag{16}$$

As a result, the sound field signal 112 in the decorrelated or eigenvalue or adaptive transform domain is obtained.

In principle, the transformation $V(\hat{d},\hat{\varphi},\hat{\theta})$ could be applied on a per sub-band basis to provide a parametric coder of the sound field signal 110. The first eigen-signal E1 contains by definition the most energy, and the eigen-signal E1 may be used as the down-mix signal 113 that is transform coded using a mono encoder 103. An additional benefit of coding the E1 signal 113 is that a similar quantization error is spread among all three channels of the sound field signal 117 at the decoder 250 when transforming back to the captured domain from the KLT domain. This reduces potential spatial quantization noise unmasking effects.

Parametric coding in the KLT domain may be performed as follows. One can apply waveform coding to the eigen-signal E1 (single mono encoder 103). Furthermore, parametric coding may be applied to the eigen-signals E2 and E3. In particular, two decorrelated signals may be generated from the eigen-signal E1 using a decorrelation method (e.g. by using delayed version of the eigen-signal E1). The energy of the decorrelated versions of the eigen-signal E1 may be adjusted, such that the energy matches the energy of the corresponding eigen-signals E2 and E3, respectively. As a result of the energy adjustment, energy adjustment gains b2 (for the eigen-signal E2) and b3 (for the eigen-signal E3) may be obtained. These energy adjustment gains (which may also be regarded as predictive parameters, together with a2) may be determined as outlined below. The energy adjustment gains b2 and b3 may be determined in a parameter estimation unit 205. The parameter estimation unit 205 may be configured to quantize and (Huffman) encode the energy adjustment gains to yield the encoded gains 216 which may be inserted into the spatial bit-stream 221. The decoded version of the encoded gains 216 (i.e. the decoded gains $\widehat{b2}$ and $b\widehat{b3}$ 215) may be used at the decoder 250 to determine reconstructed eigen-signals $\widehat{E2}$, $\widehat{E3}$ from the reconstructed eigen-signal $\widehat{E1}$. As already outlined above, the parametric coding is typically performed on a per sub-band basis, i.e. energy adjustment gains b2 (for the eigen-signal E2) and b3 (for the eigen-signal E3) are typically determined for a plurality of sub-bands.

It should be noted that the application of the KLT on a per sub-band basis is relatively expensive in terms of the number of parameters $\hat{d}$, $\hat{\varphi}$, $\hat{\theta}$ 214 that are required to be determined and encoded. For example, to describe a sub-band of a sound field signal 112 in the "E1 E2 E3" domain three (3) parameters are used to describe the KLT, namely d, φ, θ and in addition two gain adjustment parameters b2 and b3 are used. Therefore the total number of parameters is five (5) parameters per sub-band. In the case, where there are more channels describing the sound field signal, the KLT-based coding would require a significantly increased number of transformation parameters to describe the KLT. For example, a minimum number of transform parameters needed to specify a KLT in a 4 dimensional space is 6. In addition, 3 adjustment gain parameters would be used to determine the eigen-signals E2, E3 and E4 from the eigen-signal E1. Therefore, the total number of parameters would be 9 per sub-band. In a general case, having a sound field signal comprising M channels, $O(M^2)$ parameters are required to describe the KLT transform parameters and O(M) parameters are required to describe the energy adjustment which is performed on the eigen-signals. Hence, the determination of a set of transform parameters 212 (to describe the KLT) for each sub-band may require the encoding of a significant number of parameters.

In the present document an efficient parametric coding scheme is described, where the number of parameters used to code the sound field signals is always O(M) (notably, as long as the number of sub-bands N is substantially larger than the number of channels M). In particular, in the present document, it is proposed to determine the KLT transform parameters 212 for a plurality of sub-bands (e.g. for all of the sub-bands or for all of the sub-bands comprising frequencies which are higher than the frequencies comprised within a start-band). Such a KLT which is determined based on and applied to a plurality of sub-bands may be referred to as a broadband KLT. The broadband KLT only provides completely decorrelated eigen-vectors E1, E2, E3 for the combined signal corresponding to the plurality of sub-bands, based on which the broadband KLT has been determined. On the other hand, if the broadband KLT is applied to an individual sub-band, the eigen-vectors of this individual sub-band are typically not fully decorrelated. In other words, the broadband KLT generates mutually decorrelated eigen-signals only as long as full-band versions of the eigen-signals are considered. However, it turns out that there remains a significant amount of correlation (redundancy) that exists on a per sub-band basis. This correlation (redundancy) among the eigen-vectors E1, E2, E3 on a per sub-band basis can be efficiently exploited by a prediction scheme. Therefore, a prediction scheme may be applied in order to predict the eigen-vectors E2 and E3 based on the primary eigen-vector E1. As such, it is proposed to apply predictive coding to the eigen-channel representation of the sound field signals obtained by means of a broadband KLT performed on the sound field signal 111 in the "WXY" domain.

The prediction based coding scheme (or just simply "predictive coding") may provide a parameterization which divides the parameterized signals E2, E3 into a fully correlated (predicted) component and into a decorrelated (non-predicted) component derived from the down-mix signal E1. The parameterization may be performed in the frequency domain after an appropriate T-F transform 201. Certain frequency bins of a transformed time frame of the sound field signal 111 may be combined to form frequency bands that are processed together as single vectors (i.e. sub-band signals). Usually, this frequency banding is perceptually motivated. The banding of the frequency bins may lead to only one or two frequency bands for a whole frequency range of the sound field signal.

More specifically, in each time frame p (of e.g. 20 ms) and for each frequency band k, the eigen-vector E1(p,k) may be used as the down-mix signal 113, and eigen-vectors E2(p,k) and E3(p,k) may be reconstructed as $$E2(p,k)=a2(p,k)*E1(p,k)+b2(p,k)*d(E1(p,k)) \quad (17)$$

$$E3(p,k)=a3(p,k)*E1(p,k)+b3(p,k)*d(E1(p,k)) \quad (18)$$

with a2, b2, a3, b3 being parameters of the parameterization and with d(E1(p,k)) being decorrelated version of E1(p,k), but may be different for E2 and E3, and may be represented as d2(E1(p,k)) and d3(E1(p,k)). Instead of E1(p,k) 113, a reconstructed version $\widehat{E1}$(p,k) 261 of the down-mix signal E1(p,k) 113 (which is also available at the decoder 250) may be used in the above formulas.

At the encoder 1200 (within unit 104 and in particular within unit 205), the prediction parameters a2 and a3 may be calculated as MSE (mean square error) estimators between the down-mix signal E1, and E2 and E3, respectively. For example, in a real-valued MDCT domain, the prediction parameters a2 and a3 may be determined as (possibly using $\widehat{E1}$(p,k) instead of E1(p,k)):

$$a2(p,k)=(E1^T(p,k)*E2(p,k))/(E1^T(p,k)*E1(p,k)) \quad (19)$$

$$a3(p,k)=(E1^T(p,k)*E3(p,k))/(E1^T(p,k)*E1(p,k)) \quad (20)$$

where T indicates a vector transposition. As such, the predicted component of the eigen-signals E2 and E3 may be determined using the prediction parameters a2 and a3.

The determination of the decorrelated component of the eigen-signals E2 and E3 makes use of the determination of two uncorrelated versions of the down-mix signal E1 using the decorrelators d2( ) and d3( ). Typically, the quality (performance) of the decorrelated signals d2(E1(p,k)) and d3(E1(p,k)) has an impact on the overall perceptual quality of the proposed coding scheme. Different decorrelation methods may be used. By way of example, a frame of the down-mix signal E1 may be all-pass filtered to yield corresponding frames of the decorrelated signals d2(E1(p,k)) and d3(E1(p,k)). In the coding of 3-channel sound field signals, it turns out that perceptually stable results may be achieved by using as the decorrelated signals delayed versions (i.e. stored previous frames) of the down-mix signal E1 (or of the reconstructed down-mix signal $\widehat{E1}$, e.g. $\widehat{E1}$(p−1, k) and $\widehat{E1}$(p−2, k).

If the decorrelated signals are replaced by mono-coded residual signals, the resulting system achieves again waveform coding, which may be advantageous if the prediction gains are high. For example, one may consider to explicitly determine the residual signals resE2(p,k)=E2(p,k)−a2(p,k)*E1(p,k)), and resE3(p,k)=E3(p,k)−a3(p,k)*E1(p,k)), which have the properties of decorrelated signals (at least from the point of view of the assumed model, given by equations (17) and (18)). Waveform coding of these signals resE2(p,k) and resE3(p,k) may be considered as an alternative to the usage of synthetic decorrelated signals. Further instances of the mono codec may be used to perform explicit coding of the residual signals resE2(p,k) and resE3(p,k). This would be disadvantageous, however, as the bit-rate required for conveying the residuals to the decoder would be relatively high. On the other hand, an advantage of such an approach is that it facilitates decoder reconstruction that approaches perfect reconstruction as the allocated bit-rate becomes large.

The energy adjustment gains b2(p,k) and b3(p,k) for the decorrelators may be computed as $$b2(p,k)=\mathrm{norm}(E2(p,k)-a2(p,k)*E1(p,k))/\mathrm{norm}(E1(p,k)) \quad (21)$$

$$b3(p,k)=\mathrm{norm}(E3(p,k)-a3(p,k)*E1(p,k))/\mathrm{norm}(E1(p,k)) \quad (22)$$

where norm( ) indicates the RMS (root mean squared) operation. The down-mix signal E1(p,k) may be replaced by the reconstructed down-mix signal $\widehat{E1}$(p,k) in the above formula. Using this parameterization, the variances of the two prediction error signals are reinstated at the decoder 250.

It should be noted that the signal model given by the equations (17) and (18) and the estimation procedure to determine the energy adjustment gains b2(p,k) and b3(p,k) given by equations (21) and (22) assume that the energy of the decorrelated signals d2(E1(p,k)) and d3(E1(p,k)) matches (at least approximately) the energy of the down-mix signal E1(p,k). Depending on the decorrelators used, this may not be the case (e.g. when using the delayed versions of E1(p,k), the energy of E1(p−1,k) and E1(p−2,k) may differ from the energy of E1(p,k)). In addition, the decoder 250 has only access to a decoded version $\widehat{E1}$(p,k) of E1(p,k), which, in principle, can have a different energy than the uncoded down-mix signal E1(p,k).

In view of the above, the encoder 1200 and/or the decoder 250 may be configured to adjust the energy of the decorrelated signals d2(E1(p,k)) and d3(E1(p,k)) or to further adjust the energy adjustment gains b2(p,k) and b3(p,k) in order to take into account the mismatch between the energy of the decorrelated signals d2(E1(p,k)) and d3(E1(p,k)) and the energy of E1(p,k) (or $\widehat{E1}$(p,k)). As outlined above, the decorrelators d2( ) and d3( ) may be implemented as a one frame delay and a two frame delay, respectively. In this case, the aforementioned energy mismatch typically occurs (notably in case of signal transients). In order to ensure the correctness of the signal model given by formulas (17) and (18) and in order to insert an appropriate amount of the decorrelated signals d2(E1(p,k)) and d3(E1(p,k)) during reconstruction, further energy adjustments should be performed (at the encoder 1200 and/or at the decoder 250).

In an example, the further energy adjustment may operate as follows. The encoder 1200 may have inserted (quantized and encoded versions ok) the energy adjustments gains b2(p,k) and b3(p,k) (determined using formulas (21) and (22)) into the spatial bit-stream 221. The decoder 250 may be configured to decode the energy adjustment gains b2(p,k) and b3(p,k) (in prediction parameter decoding unit 255), to yield the decoded adjustment gains $\widehat{b2}$(p,k) and $\widehat{b3}$(p,k) 215. Furthermore, the decoder 250 may be configured to decode the encoded version of the down-mix signal E1(p,k) using the waveform decoder 251 to yield the decoded down-mix signal MD(p,k) 261 (also denoted as $\widehat{E1}$(p,k) in the present document). In addition, the decoder 250 may be configured to generate decorrelated signals 264 (in the decorrelator unit 252) based on the decoded down-mix signals MD(p,k) 261, e.g. by means of a one or two frame delay (denoted by p−1 and p−2), which can be written as:

$$D2(p,k)=d2(MD(p,k))=MD(p-1,k) \tag{24}$$

$$D3(p,k)=d3(MD(p,k))=MD(p-2,k) \tag{25}$$

The reconstruction of E2 and E3 may be performed using updated energy adjustment gains, which may be denoted as b2new(p,k) and b3new(p,k). The updated energy adjustment gains b2new(p,k) and b3new(p,k) may be computed according to the following formulas:

$$b2\text{new}(p,k)=b2(p,k)*\text{norm}(MD(p,k))/\text{norm}(d2(MD(p,k))) \tag{26}$$

$$b3\text{new}(p,k)=b3(p,k)*\text{norm}(MD(p,k))/\text{norm}(d3(MD(p,k))) \tag{27}$$

e.g.

$$b2\text{new}(p,k)=b2(p,k)*\text{norm}(MD(p,k))/\text{norm}(MD(p-1,k)) \tag{28}$$

$$b3\text{new}(p,k)=b3(p,k)*\text{norm}(MD(p,k))/\text{norm}(MD(p-2,k)) \tag{29}$$

An improved energy adjustment method may be referred to as a "ducker" adjustment. The "ducker" adjustment may use the following formulas to compute the updated energy adjustments gains:

$$b2\text{new}(p,k)=b2(p,k)*\text{norm}(MD(p,k))/\max(\text{norm}(MD(p,k)),\text{norm}(d2(MD(p,k)))) \tag{30}$$

$$b3\text{new}(p,k)=b3(p,k)*\text{norm}(MD(p,k))/\max(\text{norm}(MD(p,k)),\text{norm}(d3(MD(p,k)))) \tag{31}$$

e.g.

$$b2\text{new}(p,k)=b2(p,k)*\text{norm}(MD(p,k))/\max(\text{norm}(MD(p,k)),\text{norm}(MD(p-1,k))) \tag{32}$$

$$b3\text{new}(p,k)=b3(p,k)*\text{norm}(MD(p,k))/\max(\text{norm}(MD(p,k)),\text{norm}(MD(p-2,k))) \tag{33}$$

This can also be written as:

$$b2\text{new}(p,k)=b2(p,k)*\min(1,\text{norm}(MD(p,k))/\text{norm}(d2(MD(p,k)))) \tag{34}$$

$$b3\text{new}(p,k)=b3(p,k)*\min(1,\text{norm}(MD(p,k))/\text{norm}(d3(MD(p,k)))) \tag{35}$$

e.g $$b2\text{new}(p,k)=b2(p,k)*\min(1,\text{norm}(MD(p,k))/\text{norm}(MD(p-1,k))) \tag{36}$$

$$b3\text{new}(p,k)=b3(p,k)*\min(1,\text{norm}(MD(p,k))/\text{norm}(MD(p-2,k))) \tag{37}$$

In the case of the "ducker" adjustment, the energy adjustment gains b2(p,k) and b3(p,k) are only updated if the energy of the current frame of the down-mix signal MD(p,k) is lower than the energy of the previous frames of the down-mix signal MD(p−1,k) and/or MD(p−2,k). In other words, the updated energy adjustment gain is lower than or equal to the original energy adjustment gain. The updated energy adjustment gain is not increased with respect to the original energy adjustment gain. This may be beneficial in situation, where an attack (i.e. a transition from low energy to high energy) occurs within the current frame MD(p,k). In such a case, the decorrelated signals MD(p−1,k) and MD(p−2,k) typically comprise noise, which would be emphasized by applying a factor greater than one to the energy adjustment gains b2(p,k) and b3(p,k). Consequently, by using the above mentioned "ducker" adjustment, the perceived quality of the reconstructed sound field signals may be improved.

The above mentioned energy adjustment methods require as input only the energy of the decoded down-mix signal MD per sub-band f (also referred to as the parameter band k) for the current and for the two previous frames, i.e., p, p−1, p−2.

It should be noted that the updated energy adjustment gains b2new(p,k) and b3new(p,k) may also be determined directly at the encoder 1200 and may be encoded and inserted into the spatial bit-stream 221 (in replacement of the energy adjustment gains b2(p,k) and b3(p,k)). This may be beneficial with regards to coding efficiently of the energy adjustment gains.

As such, a frame of a sound field signal 110 may be described by a down-mix signal E1 113, one or more sets of transform parameters 213 which describe the adaptive transform (wherein each set of transform parameters 113 describes a adaptive transform used for a plurality of sub-bands), one or more prediction parameters a2(p,k) and a3(p,k) per sub-band and one or more energy adjustment gains b2(p,k) and b3(p,k) per sub-band. The prediction parameters a2(p,k) and a3(p,k) and the energy adjustment gains b2(p,k) and b3(p,k) (collectively as predictive parameters as mentioned in previous parts), as well as the one or more sets of transform parameters (spatial parameters as mentioned in previous parts) 213 may be inserted into the spatial bit-stream 221, which may only be decoded at terminals of the teleconferencing system, which are configured to render sound field signals. Furthermore, the down-mix signal E1 113 may be encoded using a (transform based) mono audio and/or speech encoder 103. The encoded down-mix signal E1 may be inserted into the down-mix bit-stream 222, which may also be decoded at terminals of the teleconferencing system, which are only configured to render mono signals.

As indicated above, it is proposed in the present document to determine and to apply the decorrelating transform 202 to a plurality of sub-bands jointly. In particular, a broadband KLT (e.g. a single KLT per frame) may be used. The use of a broadband KLT may be beneficial with respect to the perceptual properties of the down-mix signal 113 (therefore allowing the implementation of a layered teleconferencing system). As outlined above, the parametric coding may be based on prediction performed in the sub-band domain. By doing this, the number of parameters which are used to describe the sound field signal can be reduced compared to parametric coding which uses a narrowband KLT, where a different KLT is determined for each of the plurality of sub-bands separately.

As outlined above, the predictive parameters may be quantized and encoded. The parameters that are directly related to the prediction may be conveniently coded using a frequency differential quantization followed by a Huffman code. Hence, the parametric description of the sound field signal 110 may be encoded using a variable bit-rate. In cases where a total operating bit-rate constraint is set, the rate needed to parametrically encode a particular sound field signal frame may be deducted from the total available bit-rate and the remainder 217 may be spent on 1-channel mono coding of the down-mix signal 113.

FIGS. 23*a* and 23*b* illustrate block diagrams of an example encoder 1200 and an example decoder 250. The illustrated audio encoder 1200 is configured to encode a frame of the sound field signal 110 comprising a plurality of audio signals (or audio channels). In the illustrated example, the sound field signal 110 has already been transformed from the captured domain into the non-adaptive transform domain (i.e. the WXY domain). The audio encoder 1200 comprises a T-F transform unit 201 configured to transform the sound field signal 111 from the time domain into the sub-band domain, thereby yielding sub-band signals 211 for the different audio signals of the sound field signal 111.

The audio encoder 1200 comprises a transform determination unit 203, 204 configured to determine an energy-compacting orthogonal transform V (e.g. a KLT) based on a frame of the sound field signal 111 in the non-adaptive transform domain (in particular, based on the sub-band signals 211). The transform determination unit 203, 204 may comprise the covariance estimation unit 203 and the transform parameter coding unit 204. Furthermore, the audio encoder 1200 comprises a transform unit 202 (also referred to as decorrelating unit) configured to apply the energy-compacting orthogonal transform V to a frame derived from the frame of the sound field signal (e.g. to the sub-band signals 211 of the sound field signal 111 in the non-adaptive transform domain). By doing this, a corresponding frame of a rotated sound field signal 112 comprising a plurality of rotated audio signals E1, E2, E3 may be provided. The rotated sound field signal 112 may also be referred to as the sound field signal 112 in the adaptive transform domain.

Furthermore, the audio encoder 1200 comprises a waveform coding unit 103 (also referred to as mono encoder or down-mix encoder) which is configured to encode the first rotated audio signal E1 of the plurality of rotated audio signals E1, E2, E3 (i.e. the primary eigen-signal E1). In addition, the audio encoder 1200 comprises a parametric encoding unit 104 (also referred to as parametric coding unit) which is configured to determine a set of predictive parameters a2, b2 for determining a second rotated audio signal E2 of the plurality of rotated audio signals E1, E2, E3, based on the first rotated audio signal E1. The parametric encoding unit 104 may be configured to determine one or more further sets of predictive parameters a3, b3 for determining one or more further rotated audio signals E3 of the plurality of rotated audio signals E1, E2, E3. The parametric encoding unit 104 may comprise a parameter estimation unit 205 configured to estimate and encode the set of predictive parameters. Furthermore, the parametric encoding unit 104 may comprise a prediction unit 206 configured to determine a correlated component and a decorrelated component of the second rotated audio signal E2 (and of the one or more further rotated audio signals E3), e.g. using the formulas described in the present document.

The audio decoder 250 of FIG. 23*b* is configured to receive the spatial bit-stream 221 (which is indicative of the one or more sets of predictive parameters 215, 216 and of the one or more transform parameters (spatial parameters) 212, 213, 214 describing the transform V) and the down-mix bit-stream 222 (which is indicative of the first rotated audio signal E1 113 or a reconstructed version 261 thereof). The audio decoder 250 is configured to provide a frame of a reconstructed sound field signal 117 comprising a plurality of reconstructed audio signals, from the spatial bit-stream 221 and from the down-mix bit-stream 222. The decoder 250 comprises a waveform decoding unit 251 configured to determine from the down-mix bit-stream 222 a first reconstructed rotated audio signal $\widehat{E1}$ 261 of a plurality of reconstructed rotated audio signals $\widehat{E1}$, $\widehat{E2}$, $\widehat{E3}$ 262.

Furthermore, the audio decoder 250 of FIG. 23*b* comprises a parametric decoding unit 255, 252, 256 configured to extract a set of predictive parameters a2, b2 215 from the spatial bit-stream 221. In particular, the parametric decoding unit 255, 252, 256 may comprise a spatial parameter decoding unit 255 for this purpose. Furthermore, the parametric decoding unit 255, 252, 256 is configured to determine a second reconstructed rotated audio signal $\widehat{E2}$ of the plurality of reconstructed rotated audio signals $\widehat{E1}$, $\widehat{E2}$, $\widehat{E3}$ 262, based on the set of predictive parameters a2, b2 215 and based on the first reconstructed rotated audio signal $\widehat{E1}$ 261. For this purpose, the parametric decoding unit 255, 252, 256 may comprise a decorrelator unit 252 configured to generate one or more decorrelated signals d2($\widehat{E1}$) 264 from the first reconstructed rotated audio signal $\widehat{E1}$ 261. In addition, the parametric decoding unit 255, 252, 256 may comprise a prediction unit 256 configured to determine the second reconstructed rotated audio signal $\widehat{E2}$ using the formulas (17), (18) described in the present document.

In addition, the audio decoder 250 comprises a transform decoding unit 254 configured to extract a set of transform parameters d, φ, θ 213 indicative of the energy-compacting orthogonal transform V which has been determined by the corresponding encoder 1200 based on the corresponding frame of the sound field signal 110 which is to be reconstructed. Furthermore, the audio decoder 250 comprises an inverse transform unit 105 configured to apply the inverse of the energy-compacting orthogonal transform V to the plurality of reconstructed rotated audio signals $\widehat{E1}$, $\widehat{E2}$, $\widehat{E3}$ 262 to yield an inverse transformed sound field signal 116 (which may correspond to the reconstructed sound field signal 116 in the non-adaptive transform domain). The reconstructed sound field signal 117 (in the captured domain) may be determined based on the inverse transformed sound field signal 116.

Different variations of the above mentioned parametric coding schemes may be implemented. For example, an alternative mode of operation of the parametric coding scheme, which allows full convolution for decorrelation without additional delay, is to first generate two intermediate signals in the parametric domain by applying the energy adjustment gains b2(p,k) and b3(p,k) to the down-mix signal E1. Subsequently, an inverse T-F transform may be performed on the two intermediate signals to yield two time domain signals. Then the two time domain signals may be decorrelated. These decorrelated time domain signals may be appropriately added to the reconstructed predicted signals E2 and E3. As such, in an alternative implementation, the decorrelated signals are generated in the time domain (and not in the sub-band domain).

As outlined above, the adaptive transform 102 (e.g. the KLT) may be determined using an inter-channel covariance matrix of a frame for the sound field signal 111 in the non-adaptive transform domain. An advantage of applying the KLT parametric coding on a per sub-band basis would be a possibility of reconstructing exactly the inter-channel covariance matrix at the decoder 250. This would, however, require the coding and/or transmission of $O(M^2)$ transform parameters to specify the transform V.

The above mentioned parametric coding scheme does not provide an exact reconstruction of the inter-channel covariance matrix. Nevertheless, it has been observed that good perceptual quality can be achieved for 2-dimensional sound field signals using the parametric coding scheme described in the present document. However, it may be beneficial to reconstruct the coherence exactly for all pairs of the reconstructed eigen-signals. This may be achieved by extending the above mentioned parametric coding scheme.

In particular, a further parameter γ may be determined and transmitted to describe the normalized correlation between the eigen-signals E2 and E3. This would allow the original covariance matrix of the two prediction errors to be reinstated in the decoder 250. As a consequence, the full covariance of the three-dimensional signal may be reinstated. One way of implementing this in the decoder 250 is to premix the two decorrelator signals d2(E1(p,k)) and d3(E1(p,k)) by the 2×2 matrix given by $$G(\alpha) = \frac{1}{\sqrt{1+\alpha^2}}\begin{bmatrix} 1 & \alpha \\ \alpha & 1 \end{bmatrix}, \quad \alpha = \frac{\gamma}{1+\sqrt{1-\gamma^2}}, \tag{38}$$

to yield decorrelated signals based on the normalized correlation γ. The correlation parameter γ may be quantized and encoded and inserted into the spatial bit-stream 221.

The parameter γ would be transmitted to the decoder 250 to enable the decoder 250 to generate decorrelated signals which are used to reconstruct the normalized correlation γ between the original eigen-signals E2 and E3. Alternatively the mixing matrix G could be set to fixed values in the decoder 250 as shown below which on average improves the reconstruction of the correlation between E2 and E3

$$G = \begin{bmatrix} 0.95 & 0.3122 \\ 0.3122 & 0.95 \end{bmatrix}. \tag{39}$$

The values of the fixed mixing matrix G may be determined based on a statistical analysis of a set of typical sound field signals 110. In the above example, the overall mean of $$\frac{1}{\sqrt{1+\alpha^2}}$$

is 0.95 with a standard deviation of 0.05. The latter approach is beneficial in view of the fact that it does not require the encoding and/or transmission of the correlation parameter γ. On the other hand, the latter approach only ensures that the normalized correlation γ of the original eigen-signals E2 and E3 is maintained in average.

The parametric sound field coding scheme may be combined with a multi-channel waveform coding scheme over selected sub-bands of the eigen-representation of the sound field, to yield a hybrid coding scheme. In particular, it may be considered to perform waveform coding for low frequency bands of E2 and E3 and parametric coding in the remaining frequency bands. In particular, the encoder 1200 (and the decoder 250) may be configured to determine a start band. For sub-bands below the start band, the eigen-signals E1, E2, E3 may be individually waveform coded. For sub-bands at and above the start band, the eigen-signals E2 and E3 may be encoded parametrically (as described in the present document).

Figure 24A:
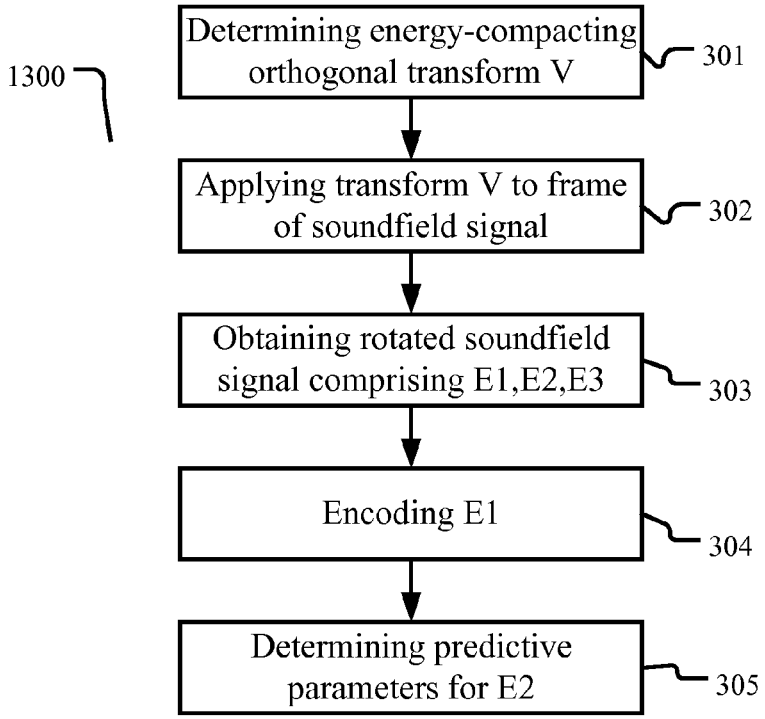
FIG. 24*a* shows a flow chart of an example method for encoding a sound field signal.

FIG. 24*a* shows a flow chart of an example method 1300 for encoding a frame of a sound field signal 110 comprising a plurality of audio signals (or audio channels). The method 1300 comprises the step of determining 301 an energy-compacting orthogonal transform V (e.g. a KLT) based on the frame of the sound field signal 110. As outlined in the present document, it may be preferable to transform the sound field signal 110 in the captured domain (e.g. the LRS domain) into a sound field signal 111 in the non-adaptive transform domain (e.g. the WXY domain) using a non-adaptive transform. In such cases, the energy-compacting orthogonal transform V may be determined based on the sound field signal 111 in the non-adaptive transform domain. The method 300 may further comprise the step of applying 302 the energy-compacting orthogonal transform V to the frame of the sound field signal 110 (or to the sound field signal 111 derived thereof). By doing this, a frame of a rotated sound field signal 112 comprising a plurality of rotated audio signals E1, E2, E3 may be provided (step 303). The rotated sound field signal 112 corresponds to the sound field signal 112 in the adaptive transform domain (e.g. the E1E2E3 domain). The method 300 may comprise the step of encoding 304 a first rotated audio signal E1 of the plurality of rotated audio signals E1, E2, E3 (e.g. using the one channel waveform encoder 103). Furthermore, the method 300 may comprise determining 305 a set of predictive parameters a2, b2 for determining a second rotated audio signal E2 of the plurality of rotated audio signals E1, E2, E3 based on the first rotated audio signal E1.

Figure 24B:
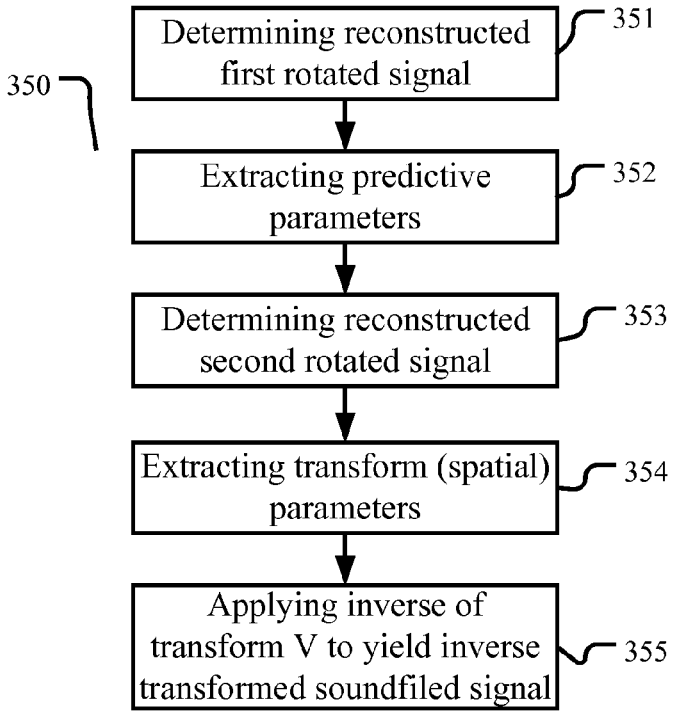
FIG. 24*b* shows a flow chart of an example method for decoding a sound field signal.

FIG. 24*b* shows a flow chart of an example method 350 for decoding a frame of the reconstructed sound field signal 117 comprising a plurality of reconstructed audio signals, from the spatial bit-stream 221 and from the down-mix bit-stream 222. The method 350 comprises the step of determining 351 from the down-mix bit-stream 222 a first reconstructed rotated audio signal $\widehat{E1}$ of a plurality of reconstructed rotated audio signals $\widehat{E1}$, $\widehat{E2}$, $\widehat{E3}$ (e.g. using the single channel waveform decoder 251). Furthermore, the method 350 comprises the step of extracting 352 a set of predictive parameters a2, b2 from the spatial bit-stream 221. The method 350 proceeds in determining 353 a second reconstructed rotated audio signal $\widehat{E2}$ of the plurality of reconstructed rotated audio signals $\widehat{E1}$, $\widehat{E2}$, $\widehat{E3}$, based on the set of predictive parameters a2, b2 and based on the first reconstructed rotated audio signal $\widehat{E1}$ (e.g. using the parametric decoding unit 255, 252, 256). The method 350 further comprises the step of extracting 354 a set of transform parameters d, φ, θ indicative of an energy-compacting orthogonal transform V (e.g. a KLT) which has been determined based on a corresponding frame of the sound field signal 110 which is to be reconstructed. Furthermore, the method 350 comprises applying 355 the inverse of the energy-compacting orthogonal transform V to the plurality of reconstructed rotated audio signals $\widehat{E1}$, $\widehat{E2}$, $\widehat{E3}$ to yield an inverse transformed sound field signal 116. The reconstructed sound field signal 117 may be determined based on the inverse transformed sound field signal 116.

In the present document methods and systems for coding sound field signals have been described. In particular, parametric coding schemes for sound field signals have been described which allow for reduced bit-rates while maintain a given perceptual quality. Furthermore, the parametric coding schemes provide a high quality down-mix signal at low bit-rates, which is beneficial for the implementation of layered teleconferencing systems.

Combination of Embodiments and Application Scenarios

All embodiments and variants thereof discussed above may be implemented in any combination thereof, and any components mentioned in different parts/embodiments but having the same or similar functions may be implemented as the same or separate components.

For example, different embodiments and variants of the first concealment unit 400 for PLC of monaural components may be randomly combined with different embodiments and variants of the second concealment unit 600 and the second transformer 1000 for PLC of spatial components. Also, in FIG. 9A and FIG. 9B, different embodiments and variants of the main concealment unit 408 for non-predictive PLC of both primary and less important monaural components may be randomly combined with different embodiments and variants of the predictive parameter calculator 412, the third concealment unit 414, the predictive decoder 410 and the adjusting unit 416 for predictive PLC of less important monaural components.

Figure 12:
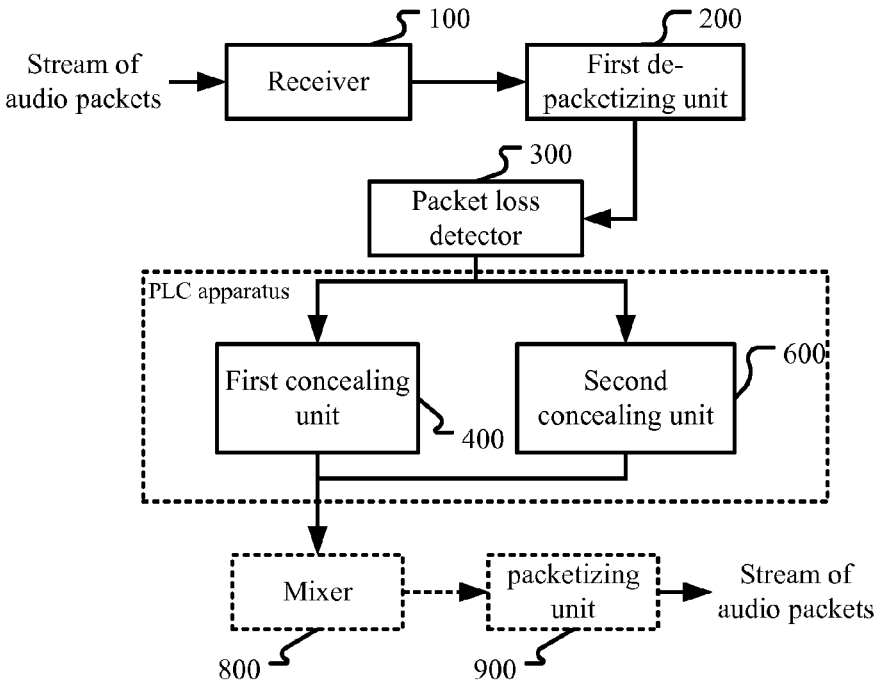
FIGS. 12-14 are diagrams illustrating applications of the packet loss concealment apparatus according to the embodiments of the present application.

As discussed before, packet loss may occur anywhere on the path from an originating communication terminal to the server (if any) and then to a destination communication terminal. Therefore, the PLC apparatus proposed by the present application may be applied in either the server or the communication terminal. When applied in a server as shown in FIG. 12, the packet-loss concealed audio signal may be again packetized by a packetizing unit 900 so as to be transmitted to the destination communication terminal. If there are multiple users talking at the same time (and this could be determined with Voice Activity Detection (VAD) techniques), before transmitting the speech signals of the multiple users to the destination communication terminal, mixing operation needs be done in a mixer 800 to mix the multiple streams of speech signals into one. This may be done after the PLC operation of PLC apparatus but before the packetizing operation of the packetizing unit 900.

Figure 13:
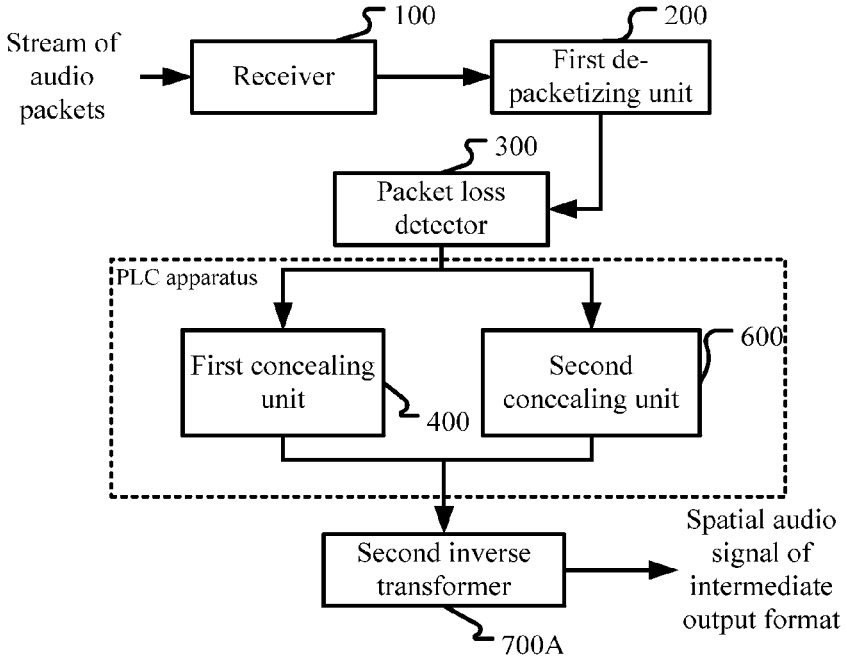
Figure 14:
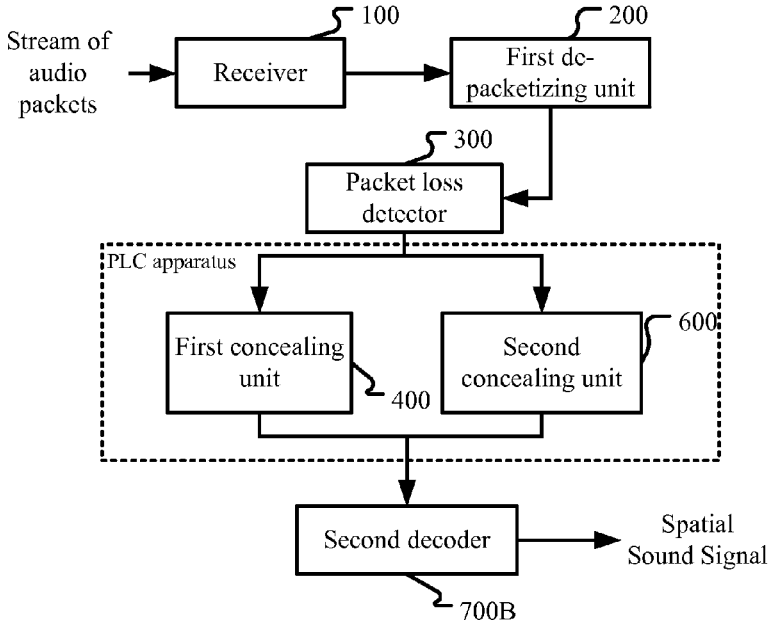

When applied in a communication terminal as shown in FIG. 13, a second inverse transformer 700A may be provided for transforming the created frame into a spatial audio signal of intermediate output format. Or, as shown in FIG. 14, a second decoder 700B may be provided for decoding the created frame into a spatial sound signal in time domain, such as binaural sound signal. The other components in FIGS. 12-14 are the same as in FIG. 3 and thus detailed description thereof is omitted.

Therefore, the present application also provides an audio processing system, such as a voice communication system, comprising a server (such as an audio conferencing mixing server) comprising the packet loss concealment apparatus as discussed before and/or a communication terminal comprising the packet loss concealment apparatus as discussed before.

It can be seen that the server and the communication terminal as shown in FIGS. 12-14 are on the destination side or decoding side because the PLC apparatus as provided are for concealing packet loss occurred before arriving the destination (including the server and the destination communication terminal). In contrast, the second transformer 1000 as discussed with reference to FIG. 11 is to be used in originating side or coding side, either in an originating communication terminal or in a server.

Figure 15:
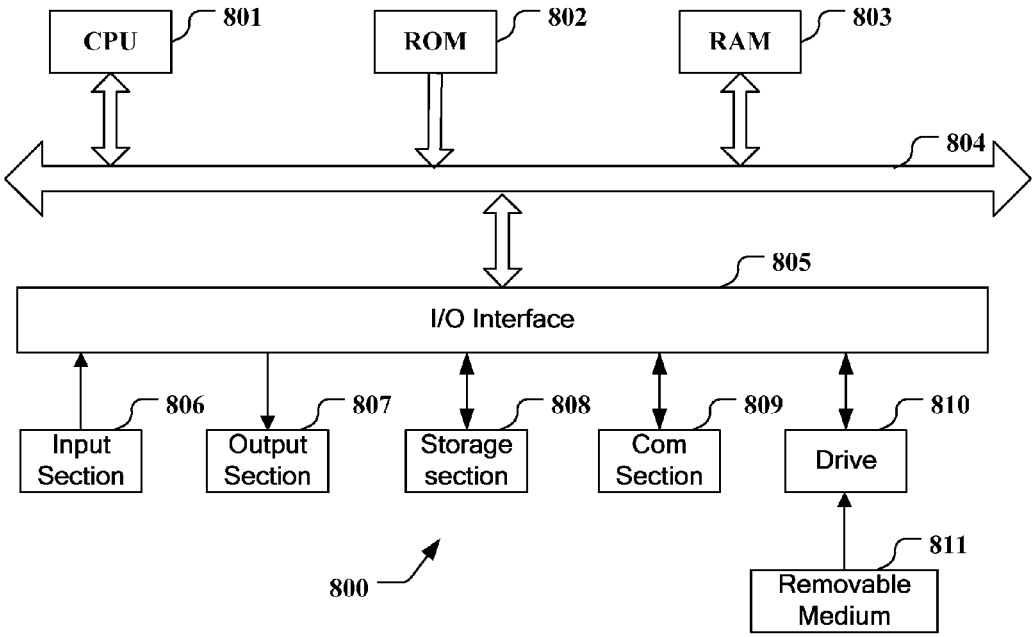
FIG. 15 is a block diagram illustrating an exemplary system for implementing embodiments of the present application.

Therefore, the audio processing system discussed above may further comprises a communication terminal, as the originating communication terminal, comprising the second transformer 1000 for transforming a spatial audio signal of input format into frames in transmission format each comprising at least one monaural component and at least one spatial component As discussed at the beginning of the Detailed Description of the present application, the embodiment of the application may be embodied either in hardware or in software, or in both. FIG. 15 is a block diagram illustrating an exemplary system for implementing the aspects of the present application.

In FIG. 15, a central processing unit (CPU) 801 performs various processes in accordance with a program stored in a read only memory (ROM) 802 or a program loaded from a storage section 808 to a random access memory (RAM) 803. In the RAM 803, data required when the CPU 801 performs the various processes or the like are also stored as required.

The CPU 801, the ROM 802 and the RAM 803 are connected to one another via a bus 804. An input/output interface 805 is also connected to the bus 804.

The following components are connected to the input/output interface 805: an input section 806 including a keyboard, a mouse, or the like; an output section 807 including a display such as a cathode ray tube (CRT), a liquid crystal display (LCD), or the like, and a loudspeaker or the like; the storage section 808 including a hard disk or the like; and a communication section 809 including a network interface card such as a LAN card, a modem, or the like. The communication section 809 performs a communication process via the network such as the internet.

A drive 810 is also connected to the input/output interface 805 as required. A removable medium 811, such as a magnetic disk, an optical disk, a magneto-optical disk, a semiconductor memory, or the like, is mounted on the drive 810 as required, so that a computer program read therefrom is installed into the storage section 808 as required.

In the case where the above-described components are implemented by the software, the program that constitutes the software is installed from the network such as the internet or the storage medium such as the removable medium 811.

Packet Loss Concealment Methods

In the process of describing the packet loss concealment apparatus in the embodiments hereinbefore, apparently disclosed are also some processes or methods. Hereinafter a summary of these methods is given without repeating some of the details already discussed hereinbefore, but it shall be noted that although the methods are disclosed in the process of describing the packet loss concealment apparatus, the methods do not necessarily adopt those components as described or are not necessarily executed by those components. For example, the embodiments of the packet loss concealment apparatus may be realized partially or completely with hardware and/or firmware, while it is possible that the packet loss concealment methods discussed below may also be realized totally by a computer-executable program, although the methods may also adopt the hardware and/or firmware of the packet loss concealment apparatus.

According to an embodiment of the present application, a packet loss concealment method is provided for concealing packet losses in a stream of audio packets, each audio packet comprising at least one audio frame in transmission format comprising at least one monaural component and at least one spatial component. In the present application, it is proposed to do different PLC for different components in the audio frames. That is, for a lost frame in a lost packet, we perform one operation for creating the at least one monaural component for the lost frame and another operation for creating the at least one spatial component for the lost frame. Note that here the two operations are not necessarily performed at the same time to the same lost frame.

The audio frame (in transmission format) may have been encoded based on adaptive transform, which may transform an audio signal (in input format, such as LRS signal or ambisonic B-format (WXY) signal) into monaural components and spatial components in transmission. One example of the adaptive transform is parametric eigen decomposition, and the monaural components may comprise at least one eigen channel component, and the spatial components may comprise at least one spatial parameter. Other examples of the adaptive transform may include principle component analysis (PCA). As for parametric eigen decomposition, one example is KLT encoding, which may result in a plurality of rotated audio signals as the eigen channel components, and a plurality of spatial parameters. Generally, the spatial parameters are deduced from a transform matrix for transforming the audio signal in input format into the audio frame in transmission format, for example, for transforming the audio signal in ambisonic B-format into the plurality of rotated audio signals.

For spatial audio signal, the continuity of the spatial parameters is very important. Therefore, for concealing a lost frame, the at least one spatial component for the lost frame may be created by smoothing the values of the at least one spatial component of adjacent frame(s), including history frame(s) and/or future frame(s). Another method is to create the at least one spatial component for the lost frame through interpolation algorithm based on the values of the corresponding spatial component in at least one adjacent history frame and at least one adjacent future frame. If there are multiple successive frames, all the lost frames may be created through a single interpolation operation. Additionally, a simpler way is to create the at least one spatial component for the lost frame by replicating the corresponding spatial component in the last frame. In the latter case, for ensuring the stability of the spatial parameters, the spatial parameters may be smoothed beforehand on the encoding side, through direct smoothing of the spatial parameters themselves, or smoothing (the elements of) the transform matrix such as the covariance matrix, which is used to derive the spatial parameters.

For the monaural components, if a lost frame is to be concealed, we can create the monaural components by replicating the corresponding monaural components in an adjacent frame. Here, an adjacent frame means a history frame or a future frame, either immediately adjacent or with other interposed frame(s). In a variant, an attenuation factor may be used. Depending on application scenarios, some monaural components may not be created for a lost frame and just at least one monaural component is created by replication. Specifically, the monaural components such as the eigen channel components (rotated audio signals) may comprise a primary monaural component and some other monaural components with different but less importance. So, we can replicate only the primary monaural component or the first two important monaural components, but not limited thereto.

It is possible that multiple successive frames have been lost, such as a lost packet comprises multiple audio frames, or multiple packets have been lost. In such a scenario, it is reasonable to create the at least one monaural component for at least one earlier lost frame by replicating the corresponding monaural component in an adjacent history frame, with or without an attenuation factor, and create the at least one monaural component for at least one later lost frame by replicating the corresponding monaural component in an adjacent future frame, with or without an attenuation factor. That is, among the lost frames, the monaural components for the earlier frame(s) will be created by replicating a history frame, and the monaural components for the later frame(s) will be created by replicating a future frame.

In addition to direct replication, in another embodiment it is proposed to do the concealment of lost monaural components in the time domain. First, we may transform the at least one monaural component in at least one history frame before the lost frame into a time-domain signal, then conceal the packet loss with respect to the time-domain signal, resulting in a packet-loss-concealed time domain signal. Finally, we may transform the packet-loss-concealed time domain signal into the format of the at least one monaural component, resulting in a created monaural component corresponding to the at least one monaural component in the lost frame. Here, if the monaural components in the audio frames are encoded with non-overlapping schema, then it is enough to transform only the monaural component in the last frame into time domain. If the monaural components in the audio frames are encoded with overlapping schema such as MDCT transform, then it is preferably to transform at least two immediately previous frames into time domain.

Alternatively, if there are more successive lost frames, a more efficient bi-directional approach could be concealing some lost frames with the time-domain PLC and some lost frames in the frequency domain. One example is the earlier lost frames are concealed with the time-domain PLC and the later lost frames are concealed through simple replication, that is, by replicating the corresponding monaural component in adjacent future frame(s). For the replication, an attenuation factor may be used or not.

Figure 16:
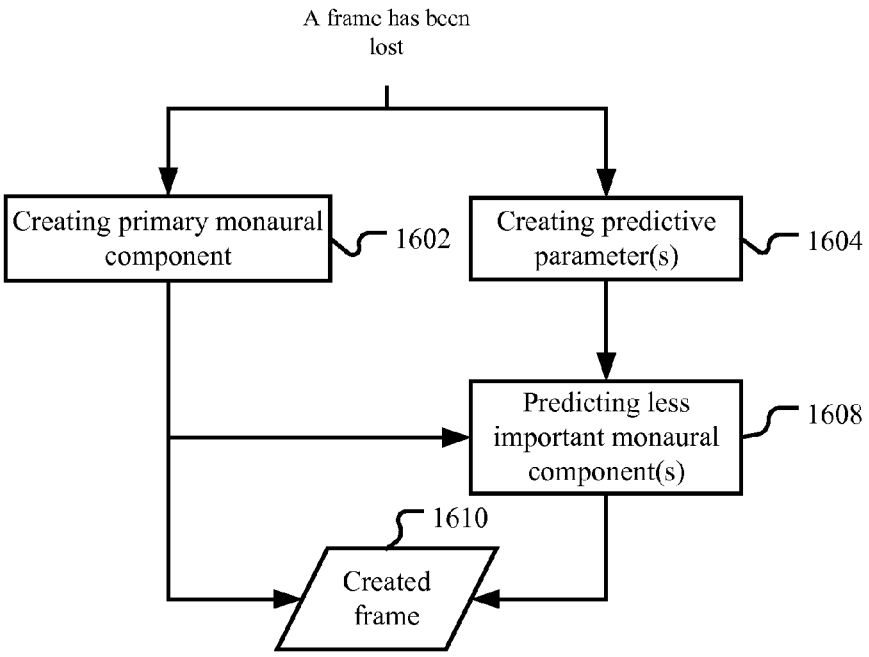
FIGS. 16-21 are flow charts illustrating concealment of monaural components in packet loss concealment methods according to embodiments of the present application and some variations thereof.

For improving the coding efficiency and bit rate efficiency, parametric/predictive coding may be adopted, wherein each audio frame in the audio stream further comprises, in addition to the spatial parameter and the at least one monaural component (generally the primary monaural component), at least one predictive parameter to be used to predict, based on the at least one monaural component in the frame, at least one other monaural component for the frame. For such an audio stream, PLC may be conducted with respect to the predictive parameter(s) as well. As shown in FIG. 16, for a lost frame, the at least one monaural component that should be transmitted (generally the primary monaural component) would be created (operation 1602), through any way existing or as discussed before, including time domain PLC, bi-directional PLC or replication with or without attenuation factor, etc. Besides that, the predictive parameter(s) for predicting the other monaural component(s) (generally the less important monaural component(s)) based on the primary monaural component may be created (operation 1604).

Creating of the predictive parameters may be implemented in a way similar to the creating of the spatial parameters, such as by replicating the corresponding predictive parameter in the last frame with or without an attenuation factor, smoothing the values of corresponding predictive parameter of adjacent frame(s), or interpolation using the values of corresponding predictive parameter in history and future frames. For the predictive PLC for discretely coded audio stream (FIGS. 18-21), the creating operation may be performed similarly.

With the primary monaural component and the predictive parameters created, the other monaural components may be predicted based there on (operation 1608), and the created primary monaural component and the predicted other monaural component(s) (together with the spatial parameters) constitute a created frame concealment the packet/frame loss. However, the predicting operation 1608 is not necessarily performed immediately after the creating operations 1602 and 1604. In a server, if mixing is not necessary, then the created primary monaural component and the created predictive parameters may be directly forwarded to the destination communication terminal, where the prediction operation 1608 and further operation(s) will be performed.

The predicting operation in the predictive PLC is similar to that in the predictive coding (even if the predictive PLC is performed with respect to a non-predictive/discrete coded audio stream). That is, the at least one other monaural component of the lost frame may be predicted based on the created one monaural component and its decorrelated version using the created at least one predictive parameter, with or without an attenuation factor. As one example, the monaural component in a history frame corresponding to the created one monaural component for the lost frame may be regarded as the decorrelated version of the created one monaural component. For the predictive PLC for discretely coded audio stream (FIGS. 18-21), the prediction operation may be performed similarly.

Figure 17:
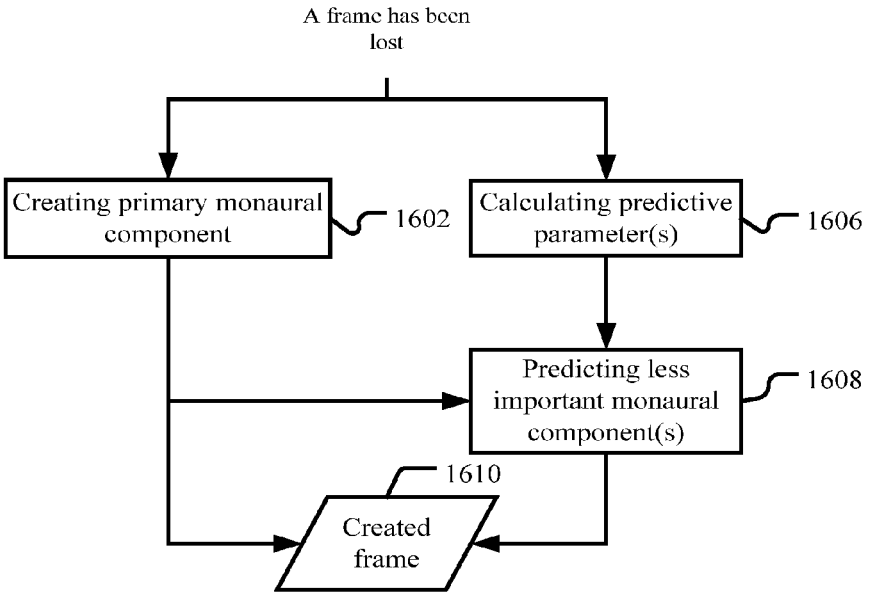

The predictive PLC may also be applied to non-predictive/discrete coded audio stream, wherein each audio frame comprises at least two monaural components, generally a primary monaural component and at least one less important monaural. In predictive PLC, a method similar to the predictive coding as discussed before is used to predict the less important monaural component based on the already created primary monaural component for concealing a lost frame. Since it is in PLC for discretely coded audio stream, there are no available predictive parameters and they cannot be calculated from the present frame (since the present frame has been lost and need be created/restored). Therefore, the predictive parameters may be derived from a history frame, whether the history frame has been normally transmitted or has been created/restored for PLC purpose. Then, in one embodiment as shown in FIG. 17, creating the at least one monaural component comprises creating one of the at least two monaural components for the lost frame (operation 1602), calculating at least one predictive parameter for the lost frame using a history frame (operation 1606), and predicting at least one other monaural component of the at least two monaural components of the lost frame based on the created one monaural component using the created at least one predictive parameter (operation 1608).

For discretely encoded audio stream, if the predictive PLC is always performed for each lost frame, sometimes the efficiency will be low especially when there are relatively more lost packets. In such a scenario, the predictive PLC for discretely encoded audio stream and normal PLC with respect to predictively encoded audio stream may be combined. That is, once the predictive parameters have been calculated for an earlier lost frame, then the subsequent lost frame may make use of the calculated predictive parameters through normal PLC operations as discussed before, such as replication, smoothing, interpolation, etc.

Figure 18:
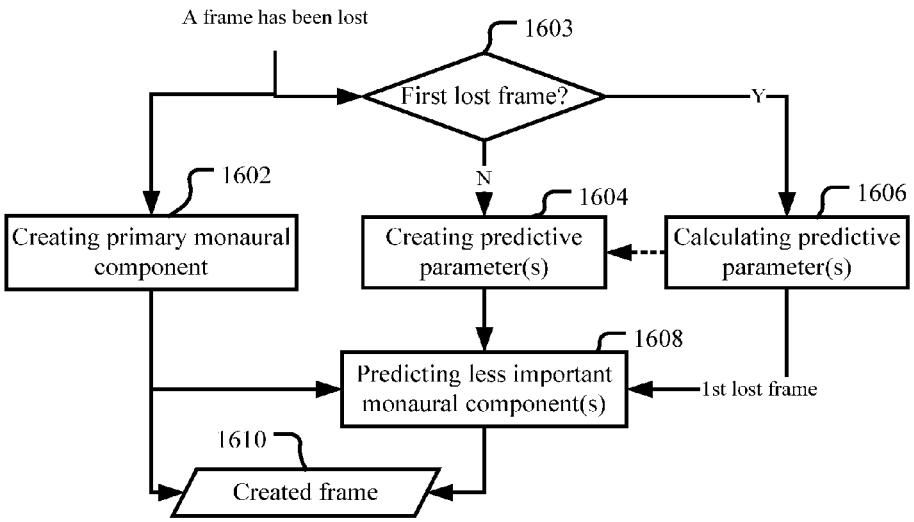

So, as shown in FIG. 18, for multiple successive lost frames, with respect to the first lost frame ("Y" in operation 1603), then predictive parameters will be calculated based on the last frame (normally transmitted) (operation 1606), and be used to predict the other monaural components (operation 1608). And beginning from the second lost frame, we may use the calculated predictive parameters for the first lost frame (see the dashed line arrow in FIG. 18) to perform normal PLC to create the predictive meters (operation 1604).

Figure 19:
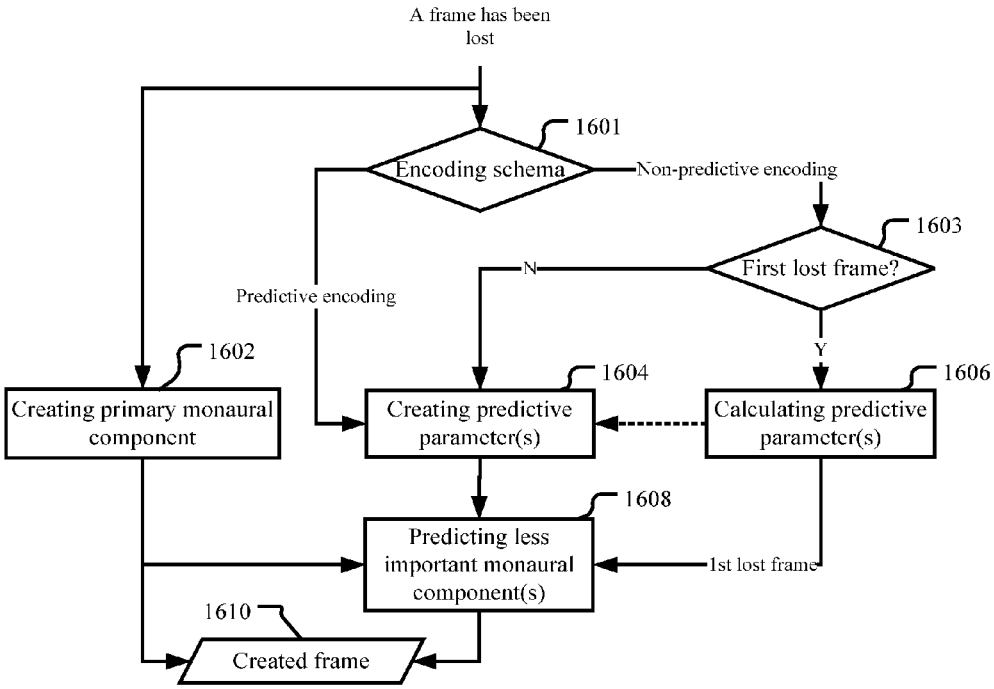

More generally, an adaptive PLC method may be proposed, which can be adaptively used for either predictive encoding schema or non-predictive/discrete encoding schema. For first lost frame in discrete encoding schema, predictive PLC will be conducted; while for subsequent lost frame(s) in discrete encoding schema, or for predictive encoding schema, normal PLC will be conducted. Specifically, as shown in FIG. 19, for any lost frame, at least one monaural component such as the primary monaural component may be created through any PLC approaches as discussed before (operation 1602). For other generally less important monaural components, they can be created/restored through different ways. If at least one predictive parameter is contained in the last frame before the lost frame ("predictive encoding" branch of the operation 1601), or if at least one predictive parameter has been calculated for the last frame before the lost frame (meaning the last frame is also a lost frame but the predictive parameters thereof have been calculated in operation 1606), or if at least one predictive parameter has been created for the last frame before the lost frame (meaning the last frame is also a lost frame but the predictive parameters thereof have been created in operation 1604), then the at least one predictive parameter for the present lost frame may be created through normal PLC approach based on the at least one predictive parameter for the last frame (operation 1604). Then, only when no predictive parameter is contained in the last frame before the lost frame ("non-predictive encoding" branch of operation 1601), and no predictive parameter has been created/calculated for the last frame before the lost frame, meaning the lost frame is the first lost frame among multiple successive lost frames ("Y" in operation 1603), the at least one predictive parameter for the lost frame may be calculated using the previous frame (operation 1606). Then, the at least one other monaural component of the at least two monaural components of the lost frame may be predicted (operation 1608) based on the created one monaural component (from operation 1602) using the calculated at least one predictive parameter (from operation 1606) or the created at least one predictive parameter (from operation 1604).

Figure 20:
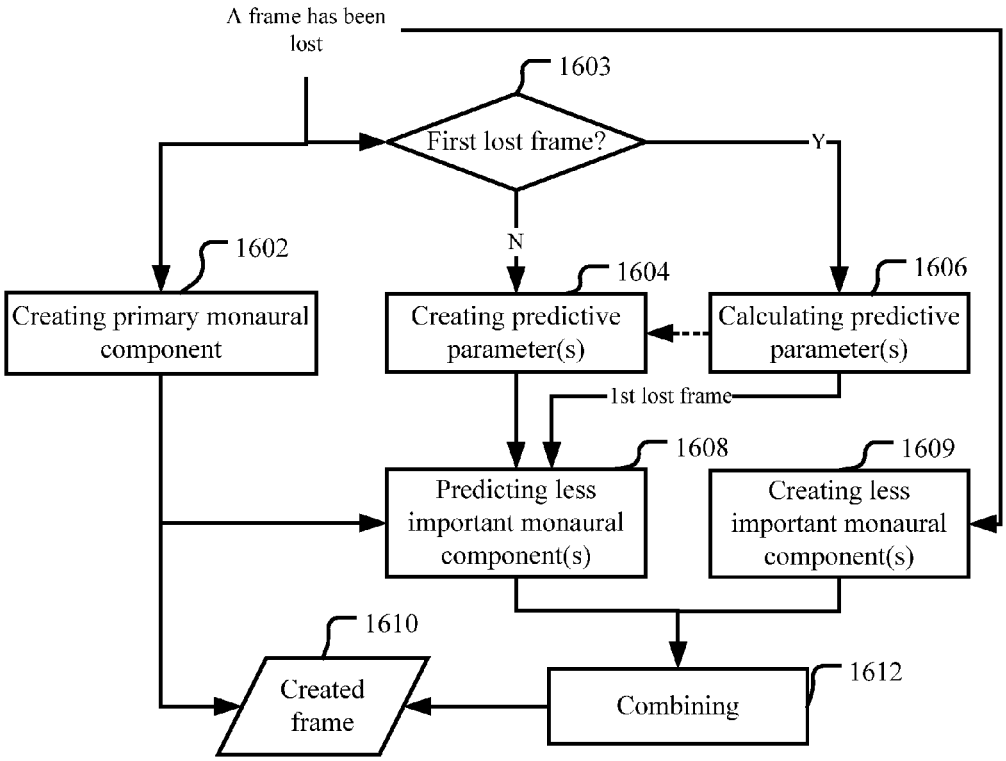
Figure 21:
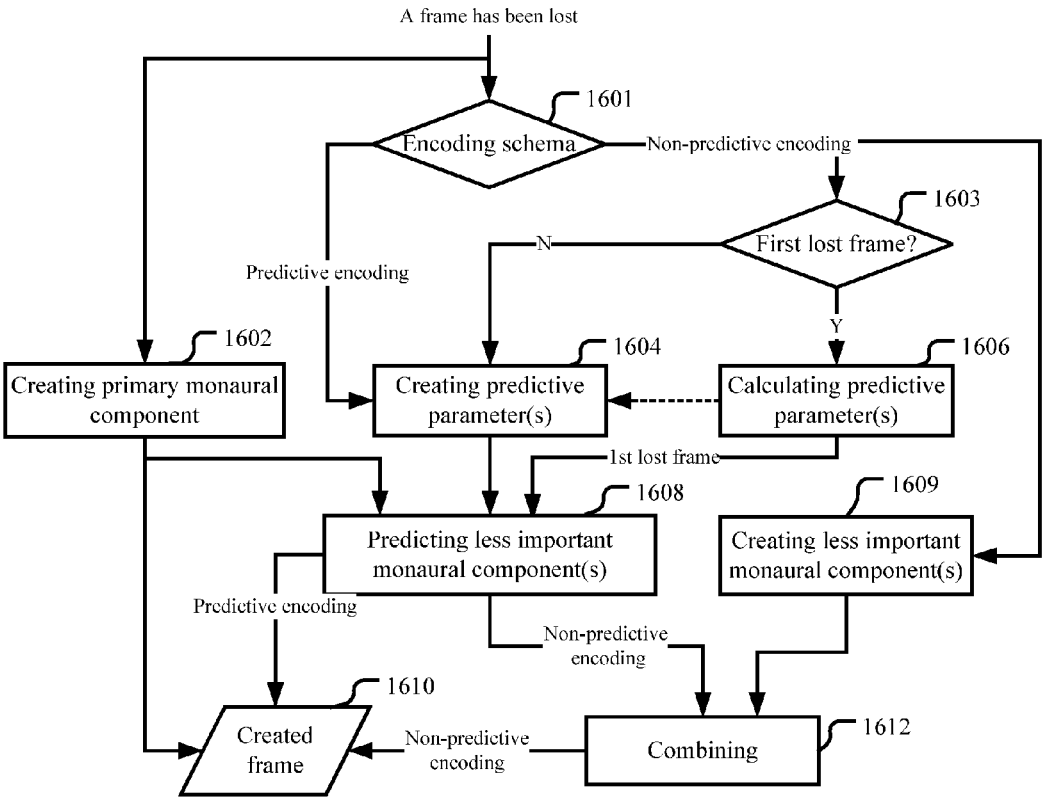

In a variant, for discretely coded audio stream, predictive PLC may be combined with normal PLC to provide more randomness in the result to make the packet-loss-concealed audio stream sound more natural. Then, as shown in FIG. 20 (corresponding to FIG. 18), both predicting operation 1608 and creating operation 1609 are conducted, and the results thereof are combined (operation 1612) to get a final result. The combining operation 1612 may be regarded as an operation of adjusting one with the other in any manner. As an example, the adjusting operation may comprise calculating a weighted average of the at least one other monaural component as predicted and the at least one other monaural component as created, as a final result of the at least one other monaural component. The weighting factors will determine which one of the predicted result and the created result is dominant, and may be determined depending on specific application scenarios. For the embodiment described with reference to FIG. 19, combining operation 1612 may also be added as shown in FIG. 21, the detailed description is omitted here. Actually, for the solution shown in FIG. 17, the combining operation 1612 is also possible, although not shown.

The calculation of the predictive parameter(s) is similar to the predictive/parametric encoding process. In the predictive encoding process, the predictive parameter(s) of the present frame may be calculated based on the first rotated audio signal (E1) (the primary monaural component) and at least the second rotated audio signal (E2) (at least one less important monaural component) of the same frame (formulae (19) and (20)). Specifically, the predictive parameters may be determined such that a mean square error of a prediction residual between the second rotated audio signal (E2) (at least one less important monaural component) and the correlated component of the second rotated audio signal (E2) is reduced. The predictive parameter may further comprise an energy adjustment gain, which may be calculated based on a ratio of an amplitude of the prediction residual and an amplitude of the first rotated audio signal (E1) (the primary monaural component). In a variant, the calculation may be based on a ratio of the root mean square of the prediction residual and the root mean square of the first rotated audio signal (E1) (the primary monaural component) ((formulae (21) and (22)). For avoiding abrupt fluctuation of the calculated energy adjustment gain, a ducker adjustment operation may be applied, including determining a decorrelated signal based on the first rotated audio signal (E1) (primary monaural component); determining a second indicator of the energy of the decorrelated signal and a first indicator of the energy of the first rotated audio signal (E1) (primary monaural component); and determining the energy adjustment gain based on the decorrelated signal if the second indicator is greater than the first indicator (formulae (26)-(37)).

In the predictive PLC, the calculation of the predictive parameter(s) is similar, the difference is for the present frame (the lost frame), the predictive parameter(s) is calculated based on previous frame(s). In other words, the predictive parameter(s) is calculated for the last frame before the lost frame, and then is used for concealing the lost frame.

Therefore, in the predictive PLC, the at least one predictive parameter for the lost frame may be calculated based on the monaural component in the last frame before the lost frame corresponding to created one monaural component for the lost frame and the monaural component in the last frame corresponding to the monaural component to be predicted for the lost frame (formulae (9)). Specifically, the at least one predictive parameter for the lost frame may be determined such that a mean square error of a prediction residual between the monaural component in the last frame corresponding to the monaural component to be predicted for the lost frame and the correlated component thereof is reduced.

The at least one predictive parameter may further comprise an energy adjustment gain, which may be calculated based on a ratio of an amplitude of the prediction residual and an amplitude of the monaural component in the last frame before the lost frame corresponding to created one monaural component for the lost frame. In a variant, the second energy adjustment gain may be calculated based on a ratio of the root mean square of the prediction residual and the root mean square of the monaural component in the last frame before the lost frame corresponding to created one monaural component for the lost frame (formulae (10)).

A ducker algorithm may also be performed to ensure the energy adjustment gain will not fluctuate abruptly (formulae (11) and (12)): determining a decorrelated signal based on the monaural component in the last frame before the lost frame corresponding to created one monaural component for the lost frame; determining a second indicator of the energy of the decorrelated signal and a first indicator of the energy of the monaural component in the last frame before the lost frame corresponding to created one monaural component for the lost frame; and determining the second energy adjustment gain based on the decorrelated signal if the second indicator is greater than the first indicator.

After PLC, a new packet has been created for substituting the lost packet. Then together with the normally transmitted audio packets, the created packet may be subject to an inverse adaptive transform, to be transformed into an inverse transformed sound field signal, such as WXY signal. One example of the inverse adaptive transform may be an inverse Karhunen-Loève transform (KLT).

Similar to the embodiments of the packet loss concealment apparatus, any combination of the embodiments of the PLC methods and their variations are also possible.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

Please note the terminology used herein is for the purpose of describing particular embodiments only and is not intended to be limiting of the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present application has been presented for purposes of illustration and description, but is not intended to be exhaustive or limited to the application in the form disclosed. Many modifications and variations will be apparent to those of ordinary skill in the art without departing from the scope and spirit of the application. The embodiment was chosen and described in order to best explain the principles of the application and the practical application, and to enable others of ordinary skill in the art to understand the application for various embodiments with various modifications as are suited to the particular use contemplated.

What is claimed is:

1. A packet loss concealment apparatus for concealing packet losses in a stream of audio packets, each audio packet comprising at least one audio frame in transmission format comprising at least one monaural component and at least one spatial component, the at least one monaural component comprising at least one eigen channel component, the packet loss concealment apparatus comprises:

a first concealment unit for creating the at least one monaural component for a lost frame in a lost packet; and a second concealment unit for creating the at least one spatial component for the lost frame.

2. The packet loss concealment apparatus according to claim 1, wherein the audio frame has been encoded based on adaptive orthogonal transform.

3. The packet loss concealment apparatus according to claim 1, wherein the audio frame has been encoded based on parametric eigen decomposition and the at least one spatial component comprises at least one spatial parameter.

4. The packet loss concealment apparatus according to claim 1, wherein, the first concealment unit is configured to create the at least one monaural component for the lost frame by replicating the corresponding monaural component in an adjacent frame, with or without an attenuation factor.

5. The packet loss concealment apparatus according to claim 1, wherein at least two successive frames have been lost, and the first concealment unit is configured to create the at least one monaural component for at least one earlier lost frame by replicating the corresponding monaural component in an adjacent history frame, with or without an attenuation factor, and create the at least one monaural component for at least one later lost frame by replicating the corresponding monaural component in an adjacent future frame, with or without an attenuation factor.

6. The packet loss concealment apparatus according to claim 1, wherein the first concealment unit comprises:

a first transformer for transforming the at least one monaural component in at least one history frame before the lost frame into a time-domain signal;

a time-domain concealment unit for concealing the packet loss with respect to the time-domain signal, resulting in a packet-loss-concealed time domain signal; and a first inverse transformer for transforming the packet-loss-concealed time domain signal into the format of the at least one monaural component, resulting in a created monaural component corresponding to the at least one monaural component in the lost frame.

7. The packet loss concealment apparatus according to claim 6, wherein at least two successive frames have been lost, and the first concealment unit is further configured to create the at least one monaural component for at least one later lost frame by replicating the corresponding monaural component in an adjacent future frame, with or without an attenuation factor.

8. The packet loss concealment apparatus according to claim 1, wherein each audio frame further comprises at least one predictive parameter to be used to predict, based on the at least one monaural component in the frame, at least one other monaural component for the frame, and, the first concealment unit comprises:

a main concealment unit for creating the at least one monaural component for the lost frame, and a third concealment unit for creating the at least one predictive parameter for the lost frame.

9. The packet loss concealment apparatus according to claim 8, wherein the third concealment unit is configured to create the at least one predictive parameter for the lost frame by replicating the corresponding predictive parameter in the last frame with or without an attenuation factor, smoothing the values of corresponding predictive parameter of adjacent frame(s), or interpolation using the values of corresponding predictive parameter in history and future frames.

10. The packet loss concealment apparatus according to claim 8, further comprising:

a predictive decoder for predicting the at least one other monaural component for the lost frame based on the created one monaural component using the created at least one predictive parameter.

11. The packet loss concealment apparatus according to claim 10, wherein the predictive decoder is configured to predict the at least one other monaural component of the lost frame based on the created one monaural component and its decorrelated version using the created at least one predictive parameter, with or without an attenuation factor.

12. The packet loss concealment apparatus according to claim 11, wherein the predictive decoder is configured to take the monaural component in a history frame corresponding to the created one monaural component for the lost frame as the decorrelated version of the created one monaural component.

13. The packet loss concealment apparatus according to claim 1, wherein each audio frame comprises at least two monaural components and the first concealment unit comprises:

a main concealment unit for creating one of the at least two monaural components for the lost frame, a predictive parameter calculator for calculating at least one predictive parameter for the lost frame using a history frame, and a predictive decoder for predicting at least one other monaural component of the at least two monaural components of the lost frame based on the created one monaural component using the created at least one predictive parameter.

14. The packet loss concealment apparatus according to claim 13, wherein the first concealment unit further comprises:

a third concealment unit for, if at least one predictive parameter is contained in or has been created/calculated for the last frame before the lost frame, creating the at least one predictive parameter for the lost frame based on the at least one predictive parameter for the last frame, and wherein, the predictive parameter calculator is configured to calculate the at least one predictive parameter for the lost frame using the previous frame when no predictive parameter is contained in or has been created/calculated for the last frame before the lost frame, and the predictive decoder is configured to predict the at least one other monaural component of the at least two monaural components of the lost frame based on the created one monaural component using the calculated or created at least one predictive parameter.

15. The packet loss concealment apparatus according to claim 13, wherein the main concealment unit is further configured to create the at least one other monaural component, and the first concealment unit further comprises an adjusting unit for adjusting the at least one other monaural component predicted by the predictive decoder with the at least one other monaural component created by the main concealment unit.

16. The packet loss concealment apparatus according to claim 15, where in the adjusting unit is configured to calculate a weighted average of the at least one other monaural component predicted by the predictive decoder and the at least one other monaural component created by the main concealment unit, as a final result of the at least one other monaural component.

17. The packet loss concealment apparatus according to claim 14, wherein the third concealment unit is configured to create the at least one predictive parameter for the lost frame by replicating the corresponding predictive parameter in the last frame with or without an attenuation factor, smoothing the values of corresponding predictive parameter of adjacent frame(s), or interpolation using the values of corresponding predictive parameter in history and future frames.

18. The packet loss concealment apparatus according to claim 13, wherein the predictive decoder is configured to predict the at least one other monaural component of the lost frame based on the created one monaural component and its decorrelated version using the created at least one predictive parameter, with or without an attenuation factor.

19. A packet loss concealment method for concealing packet losses in a stream of audio packets, each audio packet comprising at least one audio frame in transmission format comprising at least one monaural component and at least one spatial component, wherein each audio frame further comprises at least one predictive parameter to be used to predict, based on the at least one monaural component in the frame, at least one other monaural component for the frame and wherein the packet loss concealment method comprises:

creating the at least one monaural component for a lost frame in a lost packet;

creating the at least one predictive parameter for the lost frame; and creating the at least one spatial component for the lost frame.

20. A non-transitory computer-readable medium having computer program instructions recorded thereon, when being executed by a processor, the instructions enabling the processor to execute a packet loss concealment method for concealing packet losses in a stream of audio packets, each audio packet comprising at least one audio frame in transmission format comprising at least one monaural component and at least one spatial component, wherein at least two successive frames have been lost and wherein the packet loss concealment method comprises:

creating the at least one monaural component for at least one earlier lost frame by replicating the corresponding monaural component in an adjacent history frame, with or without an attenuation factor; and creating the at least one spatial component for at least one later lost frame by replicating the corresponding monaural component in an adjacent future frame, with or without an attenuation factor.

* * * * *